United States Patent [19]

Zodrow

[11] 4,298,422

[45] Nov. 3, 1981

[54] LABELLING MACHINE

[75] Inventor: Rudolf Zodrow, Dusseldorf, Fed. Rep. of Germany

[73] Assignee: Jagenberg-Werke AG, Dusseldorf, Fed. Rep. of Germany

[21] Appl. No.: 146,397

[22] Filed: May 5, 1980

Related U.S. Application Data

[63] Continuation of Ser. No. 81,899, Oct. 4, 1979, abandoned.

[30] Foreign Application Priority Data

| | | | |
|---|---|---|---|
| Oct. 6, 1978 | [DE] | Fed. Rep. of Germany | 2843602 |
| Jan. 18, 1979 | [DE] | Fed. Rep. of Germany | 2901853 |
| Sep. 1, 1979 | [DE] | Fed. Rep. of Germany | 2935433 |

[51] Int. Cl.[3] ..... B65C 9/16

[52] U.S. Cl. ..... 156/568; 118/220; 118/231; 156/571; 156/578; 156/DIG. 32; 271/33

[58] Field of Search ..... 156/568, 567, 566, 571, 156/578, DIG. 35, DIG. 29, DIG. 32; 271/33; 118/220, 230, 231

[56] References Cited

U.S. PATENT DOCUMENTS

| | | | |
|---|---|---|---|
| 3,532,585 | 10/1970 | Kronseder | 156/568 |
| 3,928,120 | 12/1975 | Zodrow | 156/568 |
| 4,040,887 | 8/1977 | Zodrow | 156/571 |
| 4,060,229 | 11/1977 | Carter | 156/568 |
| 4,077,621 | 3/1978 | Knuppertz et al. | 156/571 |
| 4,127,435 | 11/1978 | Zodrow | 156/568 |

*Primary Examiner*—Michael G. Wityshyn
*Attorney, Agent, or Firm*—Kenyon & Kenyon

[57] ABSTRACT

The labelling machine has a rotatable carrier on which a plurality of label selector components are mounted. Each selector component has an outwardly curved surface and is oscillated via a drive to roll on an adhesive-application roll, to move across a label stack to pick up a label and to roll across a surface of a cylinder at a label transfer station. Various drives can be used to program the movements of the selector components relative to the rotation of the carrier.

31 Claims, 33 Drawing Figures

11
30°
112,5°
75°
30°
1
12
14

11
M2
K2
12
14

LABELLING MACHINE

This is a continuation of Ser. No. 81,899, filed Oct. 4, 1979, now abandoned.

This invention relates to a labelling machine and, more particularly, to a drive for a labelling machine.

As is known, various types of labelling machines have been used for applying labels to articles such as bottles. In one known type of labelling machine, several work stations are located in a sequence on a track, for example an adhesive application station, a label storage station and a label transfer station while one or more selector components are provided to transfer labels onto the articles. In such a machine, the label selector component has been rotatably mounted on a rotating carrier with a gear which insure a counter-rotation of the selector component relative to the carrier while being passed in front of the work stations upon rotation of the carrier. Usually, the selector component has an externally curved reception surface to receive a label upon rolling without slippage on the front label at the label storage station. The component is likewise rolled on the other work stations to receive adhesive for picking up a label and to transfer the label to an article.

In many cases, a planetary gear drive is used as the gear drive for the selector component. Such a drive usually consists of a fixed internally toothed sun-wheel in the labelling machine frame and a meshing planetary wheel on the drive shaft of the component.

In order to achieve the necessary acceleration and retardation of the rotation of the component, it has been known, for example as described in DE-PS No. 1 611 911 to locate a cam-controlled wheel-differential gear drive with a drive rocker between the planetary gear drive pinion meshing with the sun-wheel and the component drive shaft. However, such a labelling machine is not only expensive because of the considerable drive engineering work for the wheel differential drive and drive rocker, but is also subject to considerable play in the drive owing to the numerous drive components so that the necessary accuracy of the acceleration and retarding movement achieved by the gear cam control for the see-saw movement is placed in question.

In another known labelling machine for example as described in DE-AS No. 23 25 244, instead of the cam-controlled wheel-differential gear drive, another cam-controlled drive is used in the form of a pinion coupled with the component drive shaft by means of a pitched gear and meshing with the sun-wheel. As a result of the cam-control, the pinion is axially moved on the drive shaft, so that the original uniform rotation of the component due to the sun-wheel is accelerated or retarded. As compared with a labelling machine with a gear differential drive, the number of drive components is smaller in this type of labelling machine. Thus, the play in the drive sequence can also be kept smaller.

A further labelling machine is also known, for example as described in DD-PS No. 129 769 which differs from the latter described machine, in that, instead of the pitched gear of the heterogeneous drive, two rollers are provided on the opposing sides of the drive shaft, and are enclosed between single-sided cam pieces on the pinion meshing with the sun-wheel. The play in this type of gear can be kept very small as a result of the cam piece axial feed. Nevertheless, as previously, the required gearing engineering expenditure remains considerable.

Labelling machines are also known in which the rotation of the selector component is ensured by means of two lever arms guided at a fixed distance from each other in cam tracks e.g. as described in DE-AS No. 2 436 003 or by means of two pairs of contra-rotating lever arms at differing levels, with corresponding cams at the two levels e.g. as described in DE-OS No. 2 709 521. Such drives have the disadvantage that rotation in the same direction can only be achieved in practice if the lever arms are guided in cam grooves, at various levels and divided into at least two sets. A further disadvantage is that a transmission drive is unusually unavoidable, with consequent further cost and additional play.

Accordingly, it is an object of the invention to improve the drive in a labelling machine of the above type, in such a manner that the construction of the drive is simpler and involves even less play.

Briefly, the invention is utilized in a labelling machine, particularly for bottles, having a frame, a track, and a sequence of stations along the track which include an adhesive-application station, a label-storage station and a label transfer station. The machine includes a rotatable carrier which is disposed within the track and at least one label selector component which is mounted on the carrier for rotating in an opposite direction from the carrier. Each selector has an outwardly curved surface for rolling on the surfaces of the stations for applying adhesive to the curved surface, for picking-up a label on the curved surface and for applying the label to the label transfer station. In addition, a planetary drive is provided for driving the selector component relative to the carrier about its own axis. This drive includes an internally-toothed sun-wheel which is fixed in the frame and which defines a lantern gearing thereon, a drive shaft which is secured to the selector component, a planetary gear which is coupled to the drive shaft and carries a plurality of drive staves or lanterns for meshing with the lantern gearing on the sun-wheel. In accordance with the invention, the lantern gearing is provided with teeth at each station which have flanks sloped according to the required acceleration and deceleration of rotation of the selector component for a rolling contact without slippage at each station.

Whereas in the known labelling machines, a drive play may occur in at least two or three locations, with a machine according to the invention, a clearance is possible in the lantern gearing. This lantern gearing allows the otherwise common and additional drive cams to be integrated within the internal gearing of the sun-wheel. This not only means considerably reduced design-conditioned play, but also a more compact and simpler drive. Unlike the usual procedure with lantern gearing, since the teeth on the sun-wheel are not on the outside but on the inside, the usual wear of the convex top flanks of the gear wheel otherwise due to the excessive Hertzian pressure does not occur. Further, the lantern gearing has a greater internal gearing purchase, since a large part of the lantern gearing teeth are concave.

The construction of labelling machine drives essentially imposes not only the need for a simple drive with the smallest possible design-conditioned play but also—as a result of the required high speeds (50 to 100,000 labels per hour for three selector components)—a need for the lowest possible peaks in the acceleration and deceleration of the selector component. This ensures that noise and wear are maintained at a minimum.

In one embodiment, with a direct drive of the selector component by the planetary wheel, the geometric dimensions of the circular orbit of the planetary gear center point, the lantern gear radius (center point radius) of the drive staves (i.e. lanterns), the radius of each lantern, the number of lanterns, the pitch of the lantern gearing teeth flanks and the modulus of the lantern gearing teeth are all arranged in such a manner, that the point on the lantern gearing circle (center point circle) having the smallest center distance from the label storage station surface in the central position of the selector component follows a track between the adhesive application station and the label storage station, on the one hand, and between the label transfer station and the label storage station, on the other hand, in the direction of the label storage station, which changes from concave to convex with tangents at the turning points intersecting behind the level at which a label is picked-up, while being convex in the area of the label storage.

As a result of these features, the geometry as well as the position of the stations is determined to the extent that no excessively high peaks occur in the acceleration and deceleration of the selector component in the area between the adhesive application station, the label storage station and the label transfer station. In addition, there occur no loop-tracks for the lanterns which are unfavourable, because they cause noise and wear. In the case of lantern gears with rollers, a double changeover in the rotation direction occurs at each loop on the rolling track, resulting in increased noise formation and greater wear of the rollers and of the rolling surfaces of the teeth.

As a result of the other following constructions, the labelling machine can be further optimised in relation to its compact construction and, performance as well as noise and wear.

According to a first embodiment, the convex sections of the track intersect the orbit with the dispenser component in the central position before the rolling contact level of the label storage station.

According to a further embodiment, the angle of the tangents at the turning points of the track in relation to a straight line through the carrier center and the nearest point of the label rolling contact level on the orbit is from 12° to 24°.

According to a further embodiment, the carrier center point is within a circle coincident with the surface of the selector component with the component in the central position before the rolling contact level of the label storage station. In this case, the orbit radius of the planetary wheel center point is smaller than the curvature radius of the selector component surface and greater than the orbit diameter of the lantern gearing (center point orbital diameter). In particular, the ratio of the curvature radius of the selector component surface to the lantern gearing orbit radius (center point circle radius) is 2.2 to 5.2. Preferably, the curvature radius of the selector component surface and the radius of the orbit of the planetary wheel center point remains within 100 to 130 mm, whereas the orbit radius of the lantern remains within 25 to 45 mm.

Satisfactory geometric conditions for the lantern gearing teeth, the number of lanterns on the planetary wheel and the curvature radius of the roller-like adhesive application arrangement are achieved when the pitch ratio of the lantern gearing remains at 1:1.2 to 1:1.8 in the middle region of the adhesive application roller and the transmission ratio of the planetary wheel is 1:3.8 to 1:5 in the middle region of the adhesive roller and 1:2 to 1:2.6 in the middle region of the label storage station. The intersections of the track curves of adjoining lantern gearing center points are preferably within the lantern orbit in the area of the adhesive roller and outside the lantern orbit for the label storage station.

In the case of stations at equal angles in relation to the carrier center point, there is the disadvantage of unequal loading on the sun-wheel internal gearing along the various sections between stations, because of the differing rotation acceleration or retarding of the selector component from one section to another. In order to even out the internal gearing load, the stations are arranged at different angles in relation to the carrier center point, the angle between two adjacent stations depending on the necessary acceleration and/or deceleration of rotation of the dispenser component required in that angular area.

It has been found that increased wear and greater noise occur, when the lantern gearing completes a loop during operation and lifts away from the teeth. The danger of increased wear and noise is greatest, wherever the work stations by-passed by the selector component have a smaller diameter (ratio of diameter of inner circle defined by consecutive work stations namely adhesive application roller, label container and gripper-cylinder to diameter of a work station, viz. adhesive roller approx. 2:1 to 3:1). According to a further embodiment of the invention, loops and lifting off of the lantern gearing from the gear flanks is avoided, provided that according to the necessary acceleration and retarding movement requirements for the rotation of the selector component in the areas of one or several stations, i.e. of the convex or more particularly cylindrically curved rolling contact surfaces, such as adhesive rollers and/or gripper cylinders, the gear flanks are concave and free from undercut. In the fixed tooth flank track of this design, the lantern perhaps follows a sharply pointed path in the area of the teeth brace. In such a movement, the direction of rotation of the rolls meshing with the teeth flanks remains constant without the travel in the event of roller type lantern gearing. Also, when compared with convex curved teeth flanks, for instance in the area of the adhesive roller and the gripper cylinder the localised loading on the teeth flanks is greater, this can be maintained within admissible limits, so that several lanterns may mesh simultaneously with the lantern gearing.

According to one embodiment, the tooth points can be extended and flattened in the extended area over the carrying area required to ensure an uninterrupted and equal torque on the lantern gearing. In this manner, the lantern gearing runs more smoothly, with consequent favorable effect on wear and noise. Noise can also be further reduced, by ensuring that the drive is fully disconnected from the housing from the viewpoint of acoustic conductivity.

Rigid coupling of the planetary wheel with the drive shaft of the selector component is best ensured by a fixed securing of the planetary wheel on the drive shaft. This excludes any need for special bearing points on the planetary wheel and intermediate gears.

In order to ensure a wide rotation angle for the selector component and at the same time a minimal rotation angle range of the carrier, as well as the use of sun-wheel internal teeth which are not too small, while allowing suitable coverage (at least two simultaneously meshing lantern gears) in the event of very long labels (viz. 240 mm), a further lantern-carrying planetary wheel can be fixed on the drive shaft of each selector component to mesh with a further internally toothed sun-wheel secured to the machine frame located beneath the first sun-wheel and having teeth arranged in gaps related to the teeth of the first sun-wheel. It will be seen that both planetary wheels can form a single component, with a lantern gear located both on the underside and on the upper side. In the case of two sun-wheels and two lantern gear sets, it is not necessary for each sun-wheel to be complete. It suffices to provide a section of the second gear teeth in the critical areas.

Where two lantern gear sets are provided for each selector component, it is advantageous for noise-reduction, being free from clearance as well as loading, to have the geometric dimensions of the lantern gear radius and the modulus of the lantern gear teeth and the form of the teeth flanks arranged in relation to each other (while bearing in mind the movement requirements) so that two adjacent lanterns mesh with a tooth of the subordinated lantern gearing teeth alternatively between the lantern gears of the same selector component.

In such a drive, there is a minimum of three meshing lanterns. While the middle lantern is in the neutral position between the other two lanterns, the two outer lanterns remain in a favourable position to transmit the torque. In the less favourable positions, the torque is transmitted by three lanterns. The load is always taken over by one lantern pair of the one lantern set or a lantern pair of the other lantern set, each lantern pair including one tooth. Any limited play can be eliminated by adjustment of the two lantern sets and/or the teeth on both lantern gearings.

The wheels carrying the two sun-wheels and/or the two lantern planetary wheels are preferably secured or adjusted in opposing directions, to allow any play between sun-wheels and lanterns to be removed or to provide slight pre-setting.

A comparatively flatter entrance of the entrance of the lantern gears into the inner teeth of the sun-wheel(s) is achieved, for instance when each wheel of the two on a single drive shaft and the planetary wheels carrying the lantern carry three to five, particularly four lanterns set at the same angle.

Against the advantage of two lantern sets and two sun-wheels there is the big advantage that manufacturing tolerances leading to increased wear arise in the production of both sun-wheels. In the case of two one-piece sun-wheels, the workpiece has to be released on completion of the first sun-wheel in order to proceed with the second sun-wheel. This release from the chuck means that the second sun-wheel cannot be produced with the designed degree of accuracy in relationship to the first sun-wheel.

Such disadvantages can be overcome by means of an uninterrupted cam track for the lanterns, located at an offset level in relation to the sun-wheel plane.

As the points of the uninterrupted cam track are not offset at an angle to the lantern gearing of the sun-wheel as in the case of a second wheel, and only lie on an axially offset plane, the lantern gearing of the sun-wheel and the uninterrupted cam track can be manufactured from the same side. Reduction tolerances arising from tool release are thus excluded. As one lantern is permanently guided by the uninterrupted cam track, the other lanterns are more easily assisted over their dead center than a lantern guided exclusively by the lantern gearing teeth. Compared with a design comprising two lantern sets and two sun-wheels, this particular design with a single lantern set is less expensive.

In order to ensure effective additional guiding of one lantern, particularly, at individual stations, the uninterrupted cam track and its points lies preferably within the areas between stations. The specific guiding of a lantern set can be further improved by means of an uninterrupted cam track in the form of a groove. This improved guiding is particularly advantageous, when coverage by two normal lanterns (i.e. simultaneous contact of two normal lanterns with the lantern gearing teeth) is no longer ensured in the case of very long labels. In that case, the grooved cam ensures particularly good guidance of the one lantern.

In order to retain two-sided guidance of the lantern within the grooved cam at the groove cam peaks, the single lantern is arranged on a smaller roll circle than the roll circle for the remaining lanterns. As a result of this different geometry, the cam track peaks are somewhat flattened.

Improved guidance of lanterns is ensured, when the lantern gearing teeth consist of opposing intersecting groove sections.

A further improvement in lantern guidance can be achieved when the planetary gear is located on the free end of the drive shaft of the selector component and the lanterns bear on the underside, the relevant sun-wheel being located beneath the free end of the drive shaft and having fully-formed teeth points.

In this transmission, neither the drive shaft nor the planetary wheel is in the path of the lantern gearing teeth. For that reason, the teeth points can be fully formed, thus improving the guidance of the lanterns.

These meansures can be implemented not only for a single sun-wheel and a single planetary wheel carrying lanterns, but also for two superimposed internally toothed sun-wheels secured to the machine frame and having lantern gearing teeth offset in relation to each other and for two planetary wheels rigidly coupled with the drive shaft of the selector component to mesh therewith and carrying fixed lanterns. In that case, the lower sun-wheel has the fully formed teeth points. As the drive shaft must extend above the upper sun-wheel, the teeth points of the upper sun-wheel are naturally not fully formed. Nevertheless, the fully formed teeth points of the lower sun-wheel already provide considerably improved guidance.

Since, on the one hand, the upper level of the machine frame is predetermined by the stations and, on the other hand, as the drive shaft beneath the planetary gears has no bearing, there is a greater free space available beneath the planetary wheels. Accordingly, the drive, and particularly a planetary gear drive or a cam controlled drive for marking tools, can be fitted in this space. In this case, the drive shaft for such a drive is located in bearings in the carrier in the peripheral direction next to the drive shaft for each selector component.

The carrier-borne arrangement of marking tools for embossing or punching is already known (DE-AS No. 2 517 442 and DE-OS No. 2 701 808). Transmissions are also known in which they are driven either by a planetary gear drive with fixed sun wheel or a cam drive with fixed cam and guided lever arm. The marking tools can rotate without reversal or oscillation. In such known marking tools, it is common to place the drive above the machine frame upper level. This arrangement is an expensive and bulky design. The solution according to the invention eliminates this upper structure. The whole of the drive means are located in the existing housing for the selector component planetary gear transmission.

The use, however, of two sun-wheels has the disadvantage that the installation of both gearing teeth is not subject to the required manufacturing precision. These production tolerances lead to increased wear and noise. However, such a disadvantage can be eliminated by constructing the labelling machine with two superimposed sun-wheels having lantern gearing and consisting of a channel-section one-piece body, whereas the lanterns consist of a composite wear-resistant jacket with a flexibly yielding (i.e. elastic) insert for example having a Shore hardness of 90 to 98.

When both sun-wheels are located in the same component they have a fixed spatial relationship, excluding any adjustment or setting. The production of such sun-wheels nevertheless requires the release of one sun-wheel on completion before proceeding with the production of the other sun-wheel. Losses of accuracy in production due to release from tooling are compensated by the composite design lanterns.

The elastic insert perferably fills an annular space between the jacket and an inner bearing shell, the thickness of insert at the edges being so small that the production-contingent play can be compensated, and the jacket and bearing shell are securely bonded together by the insert in the peripheral and the axial directions. On the other hand, the elastic inserts not only compensate production tolerances and damp the relevant noise, but also damp vibrations and noise independent from production tolerances. The thickness of inserts is so small, that the wear-resistant material of the insert is exposed over a negligible area to the hostile effect of the lubricant used for the planetary gear drive.

According to a further embodiment, a suitable overlap of meshing lanterns can also be achieved with relatively limited design expenditure, by inserting a transmission drive between the planetary wheel and the selector component. The invention allows in extreme cases the use of a planetary wheel with only three lanterns and a single sun-wheel with a minimum of teeth and a maximum overlap of meshing even for very long labels. A minimum of teeth represents a minimum of entries and exits at the teeth peaks, i.e. in the areas of greatest loading and where the main noise formation occurs. The fact that the teeth peaks are very close to the carrier center point is also favourable from the viewpoint of noise formation and loading. In these areas, the relative speed of lanterns remains relatively low. A clearance arising from the transmission is compensated by the fact that the planetary wheel lever arm is relatively large compared with a planetary wheel transmission having its planetary wheel fixed directly on the drive shaft.

The geometric dimensions of the planetary wheel center point circular track, of the lantern radius, of the lantern orbit radius (center point radius), the steepness of teeth flanks and the modulus of the lantern gearing teeth are preferably matched in relation to each other so that the point on the orbit (center point) of the lanterns, which is at the shortest distance from the label storage station in front of the rolling contact plane with the selector in the central position, follows a convex track in the area on both sides of the label storage station, thus intersecting the orbit with the selector component in the central position in front of the rolling contact plane of the label storage station. As a result of this design, the assembly is more compact, without inadmissibly high acceleration peaks in the rotation of the selector component.

Since the volume of standard label containers (approx. 6000 labels) is not considered suitable for high outputs (approx. 70,000 labels per hour) due to the frequent topping up intervals and since label containers cannot be further extended without operational prejudice (label feed) at least one further identical selector component can be fitted to the carrier to select labels from a further label sotrage station. In this case, both planetary wheels bearing the lanterns mesh with one or two further similar internally toothed sun-wheels. As the lantern gearing according to the invention calls for a minimal height and space, both offset drives can be housed without difficulty in a standard size housing.

These and other objects and advantages of the invention will become more apparent from the following detailed description and appended claims taken in conjunction with the accompanying drawings in which:

Figure 2:
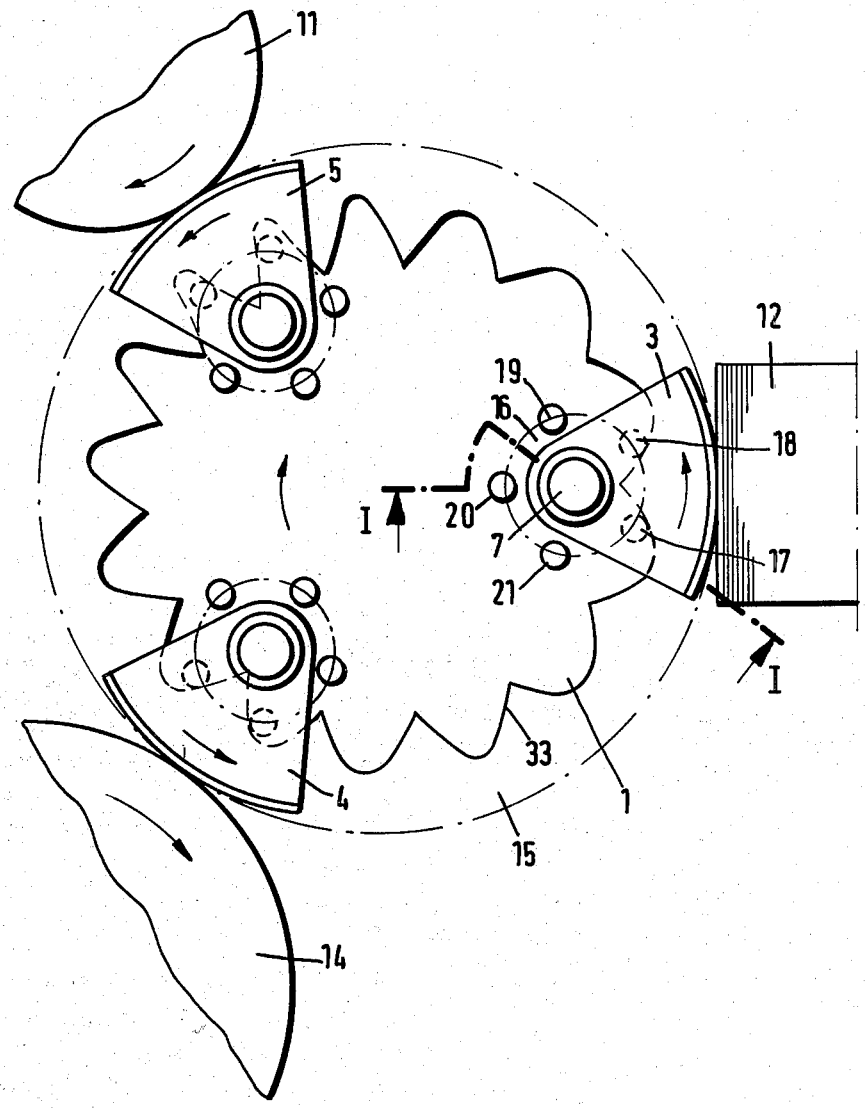
FIG. 2 illustrates a schematic view of a labelling machine as in FIG. 1, with a sun-wheel and a lantern gear set for each selector component.
Figure 5:
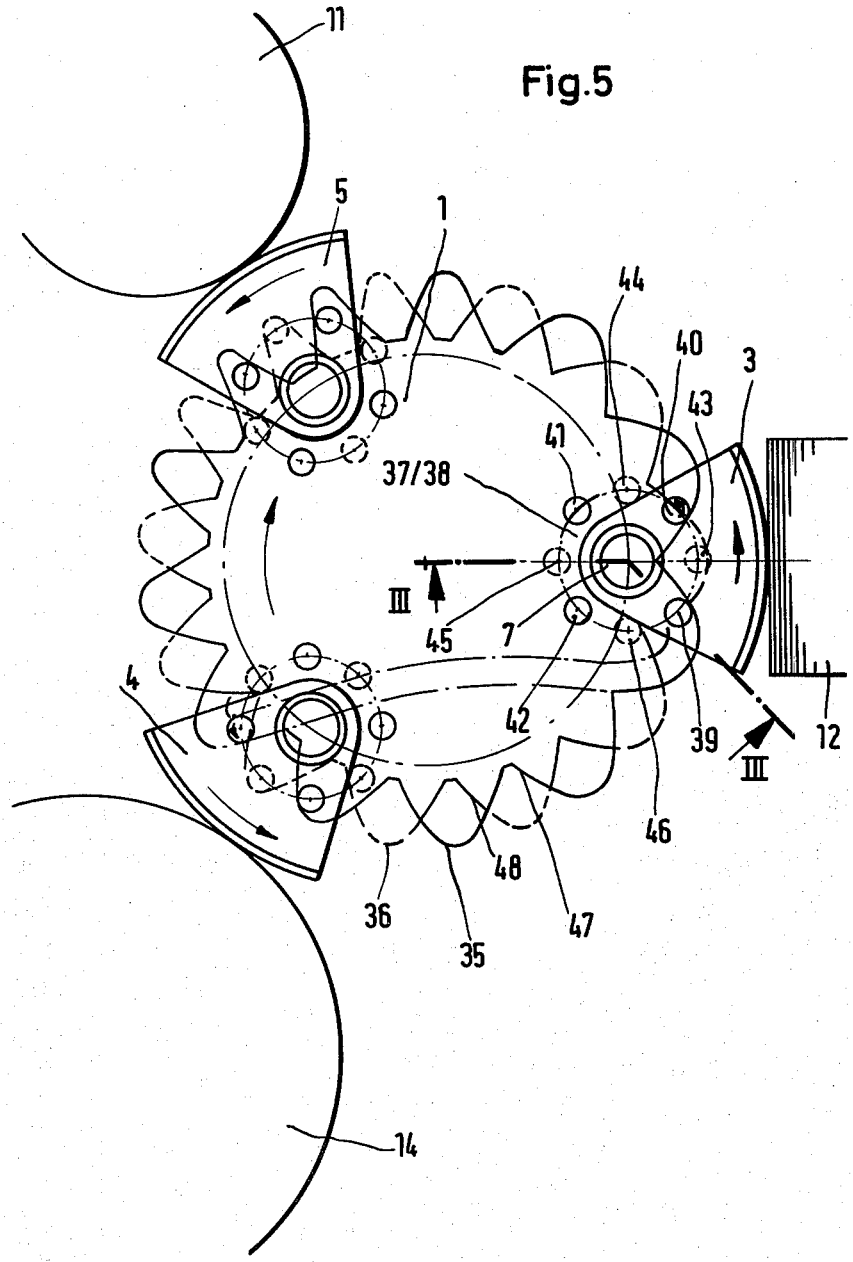
FIG. 5 illustrates a schematic view of the labelling machine of FIG. 1 with two sun-wheels and two lantern gear sets for each selector component.
Figure 8:
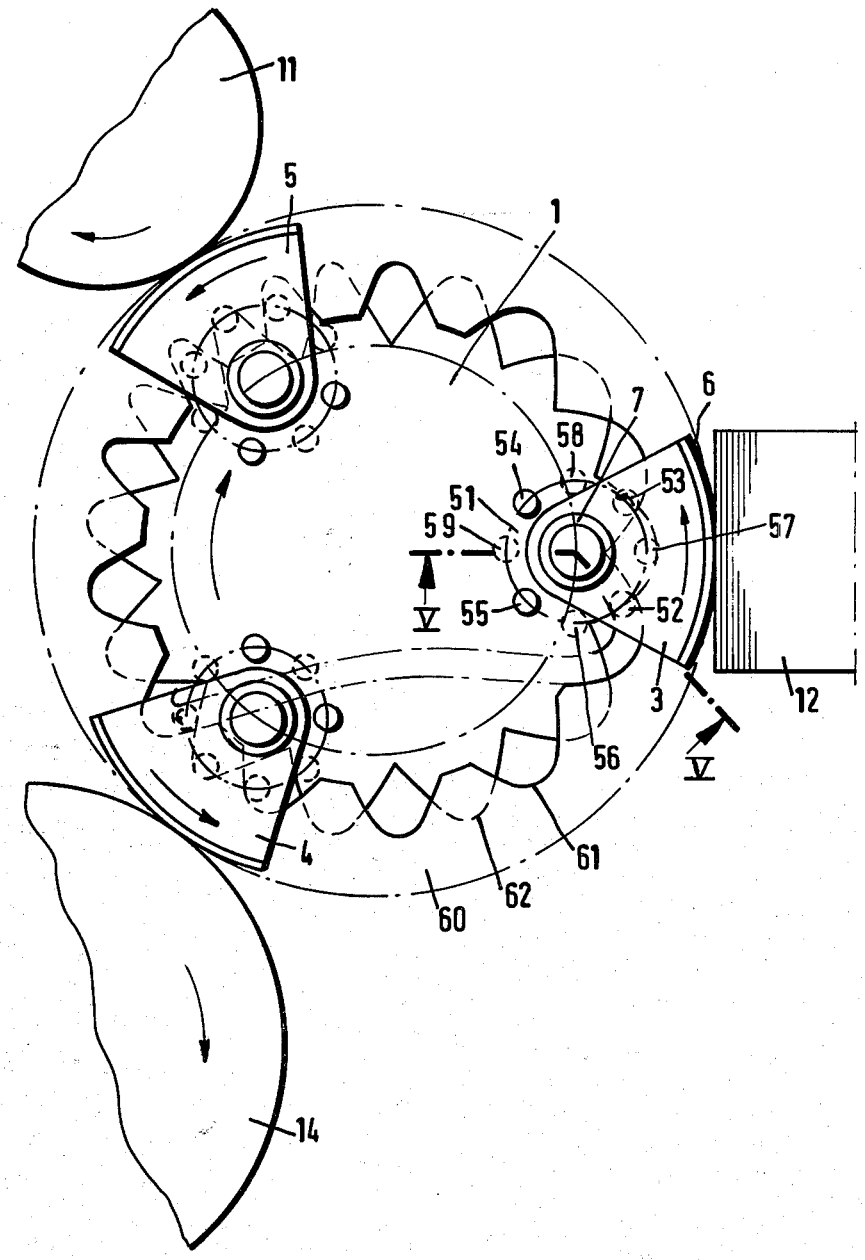
FIG. 8 illustrates a schematic view of the labelling machine of FIG. 1 with two sun-wheels and two lantern gear sets in a modified construction.
Figure 16:
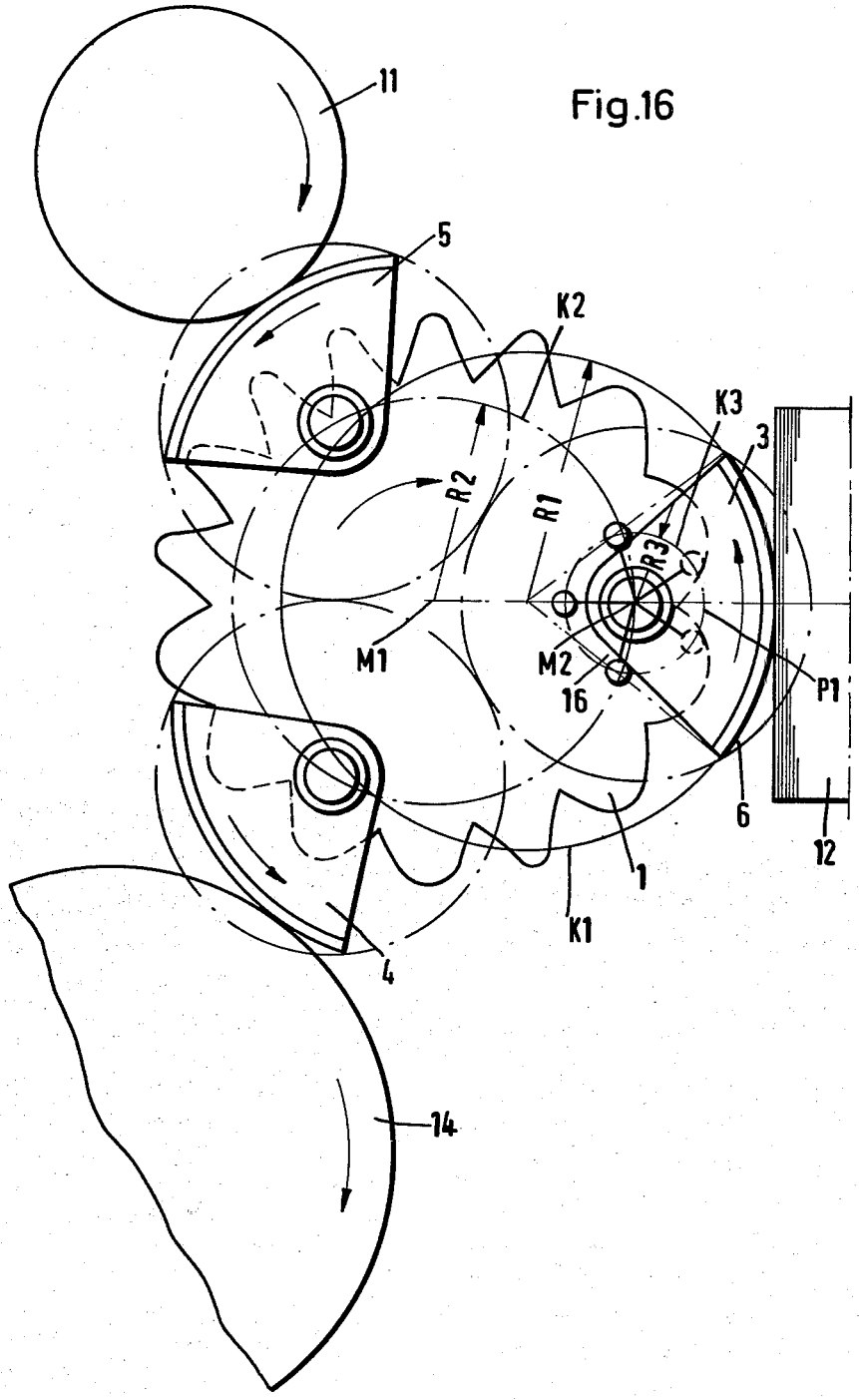
FIG. 16 illustrates a schematic view of a labelling machine with a planetary wheel fixed to the drive shaft of the selector component in accordance with the invention.
Figure 17:
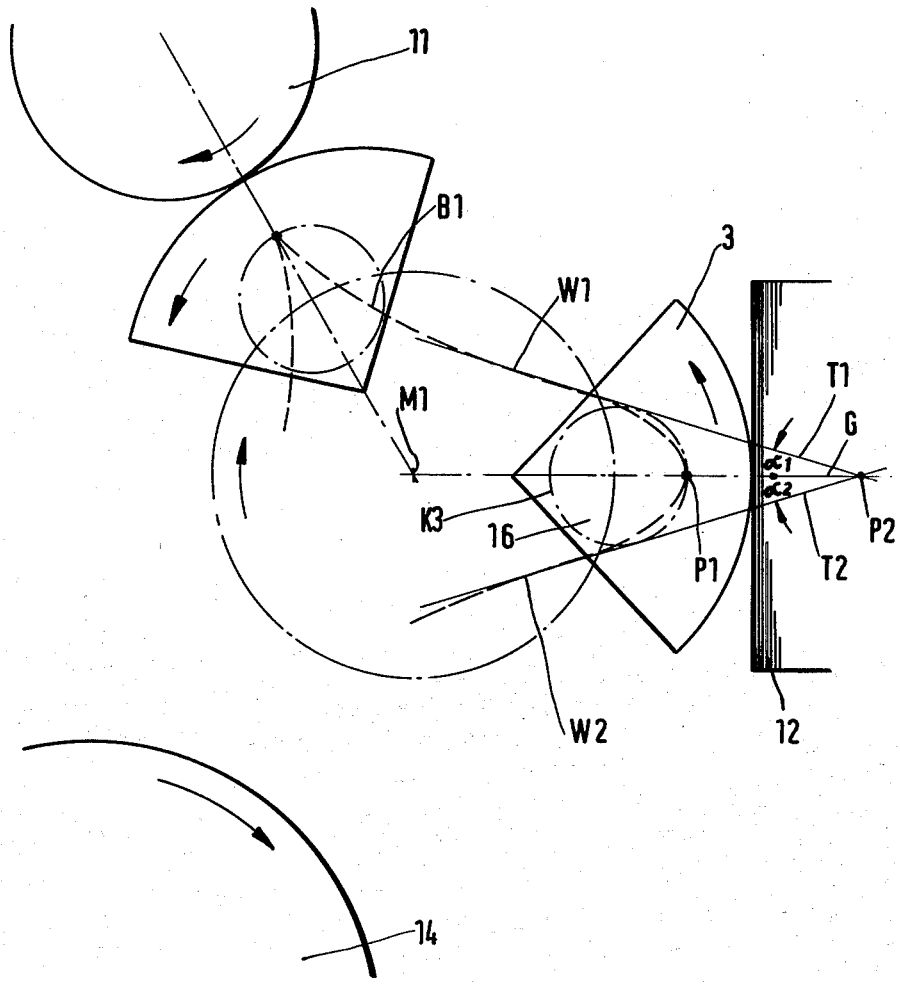
Figure 18:
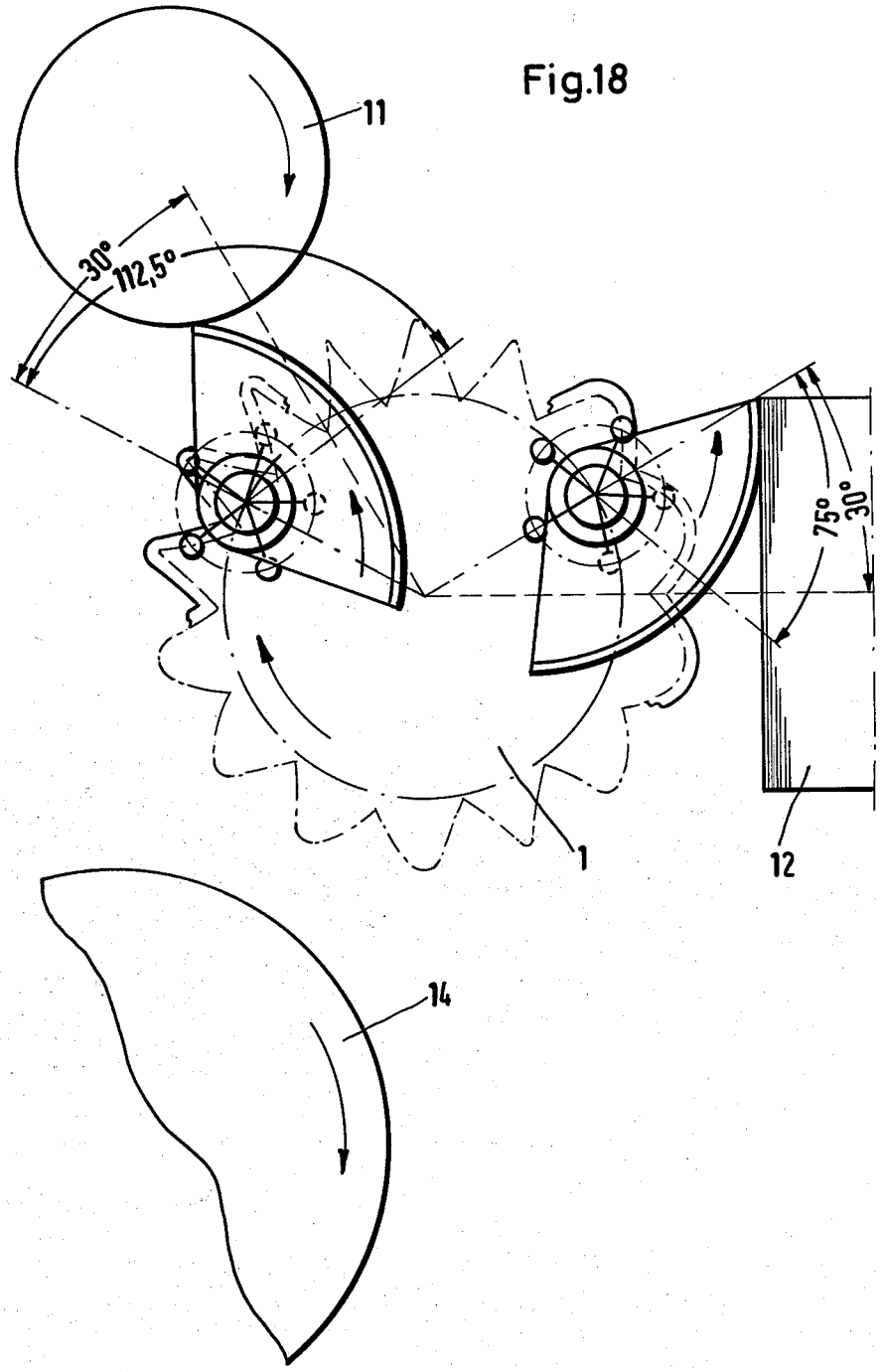
Figure 19:
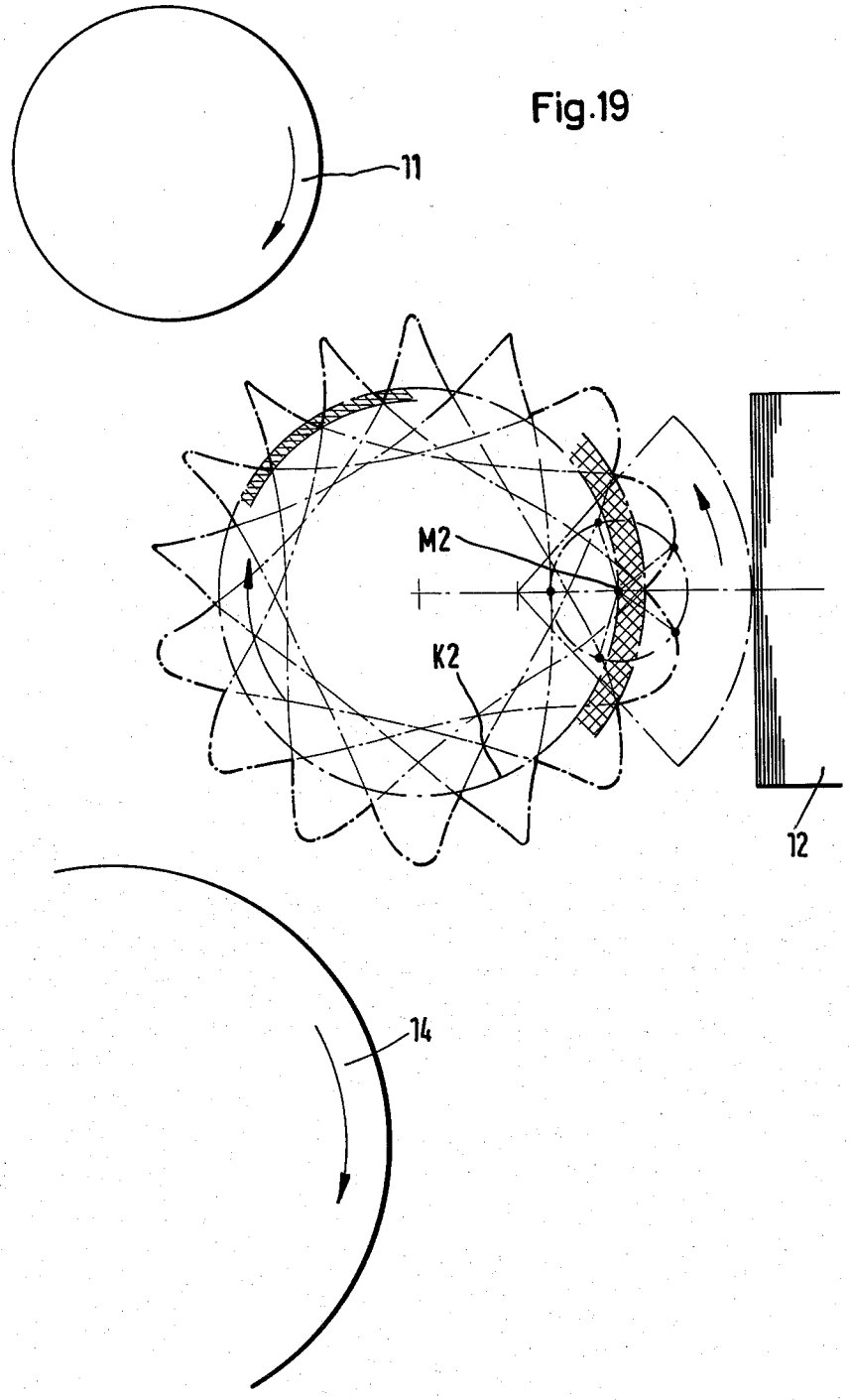
Figures 20, 21, 22:
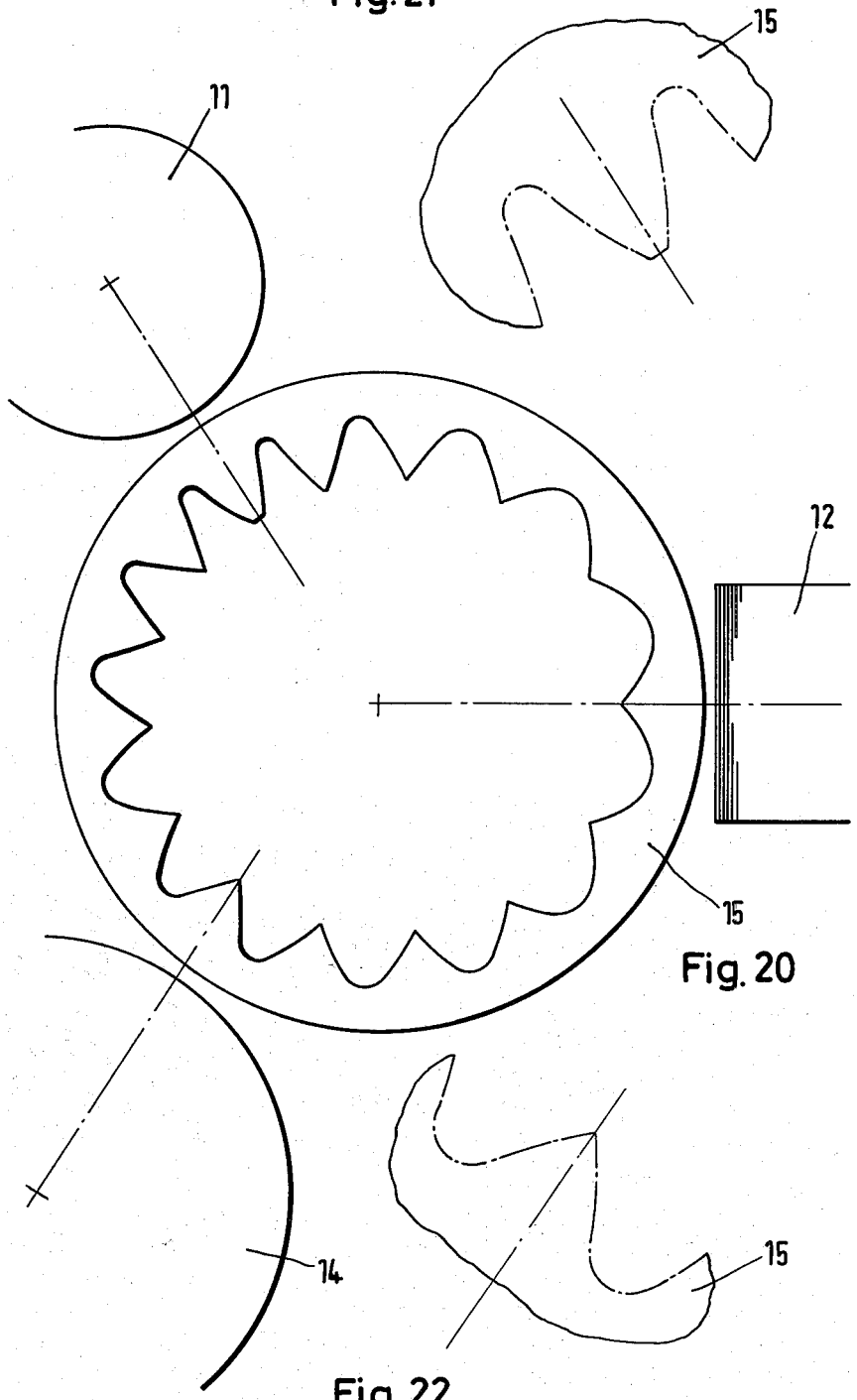
Figure 23:
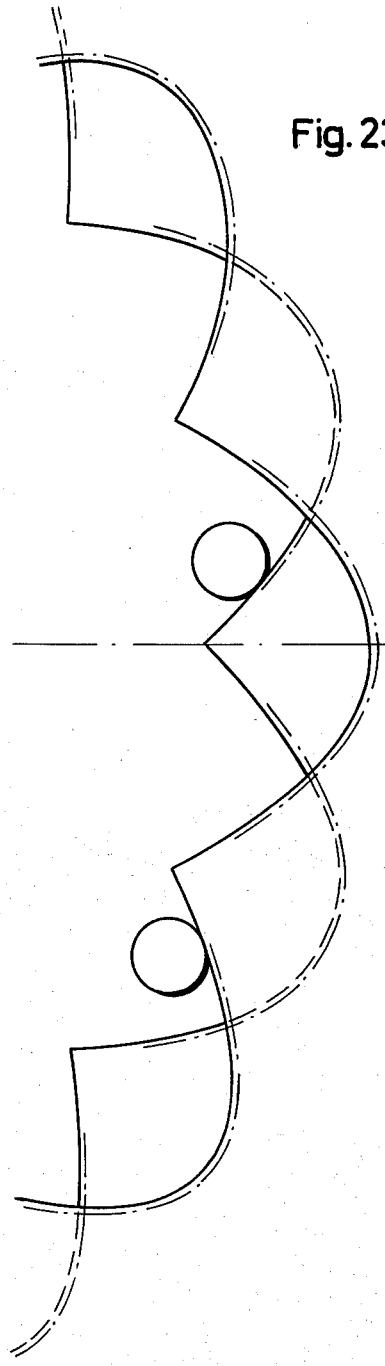
Figure 24:
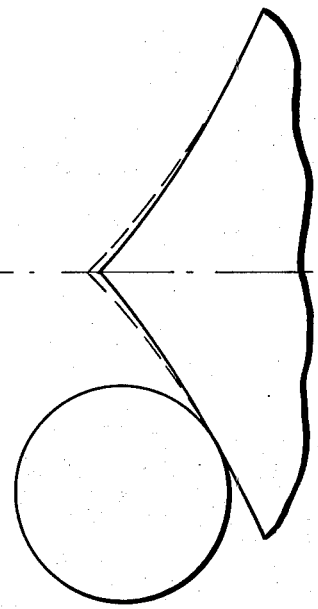
Figure 25:
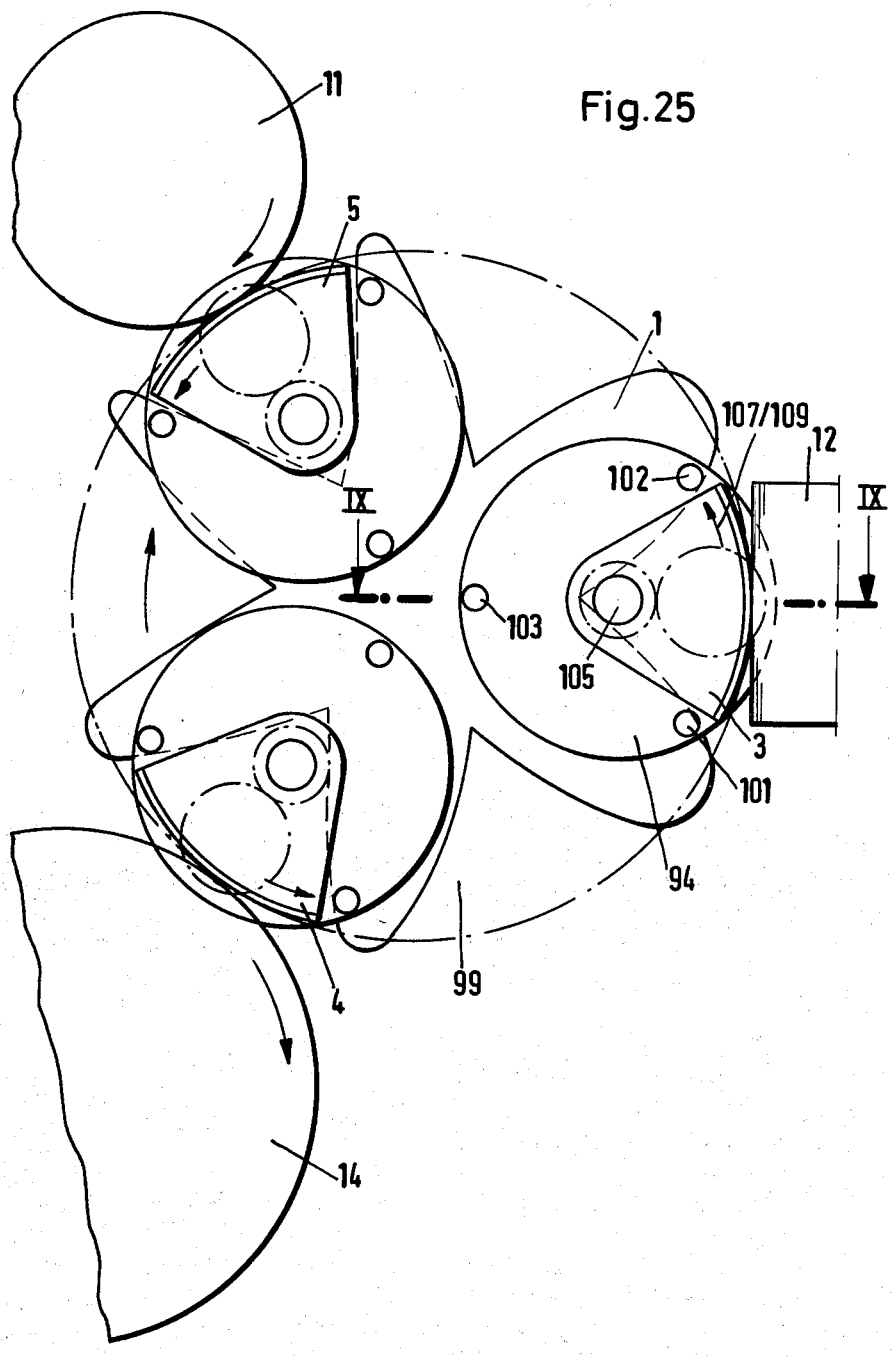
Figure 26:
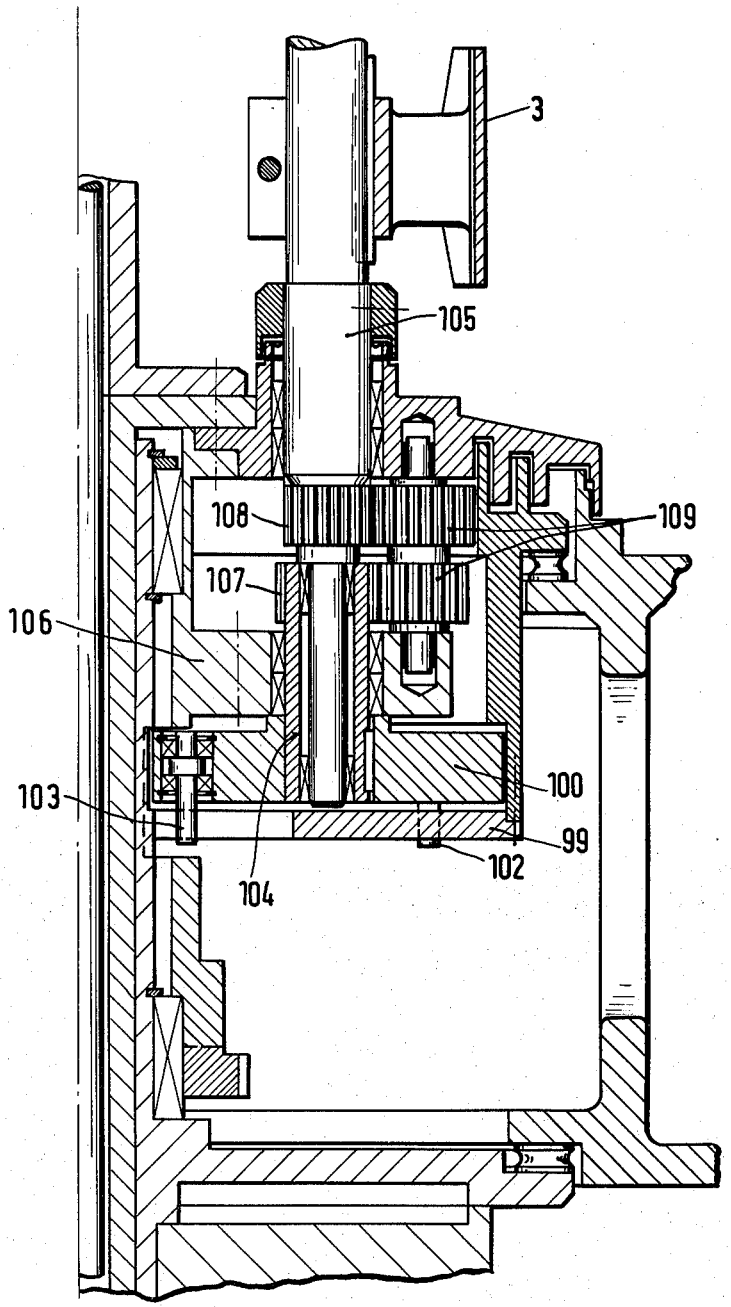
Figure 27:
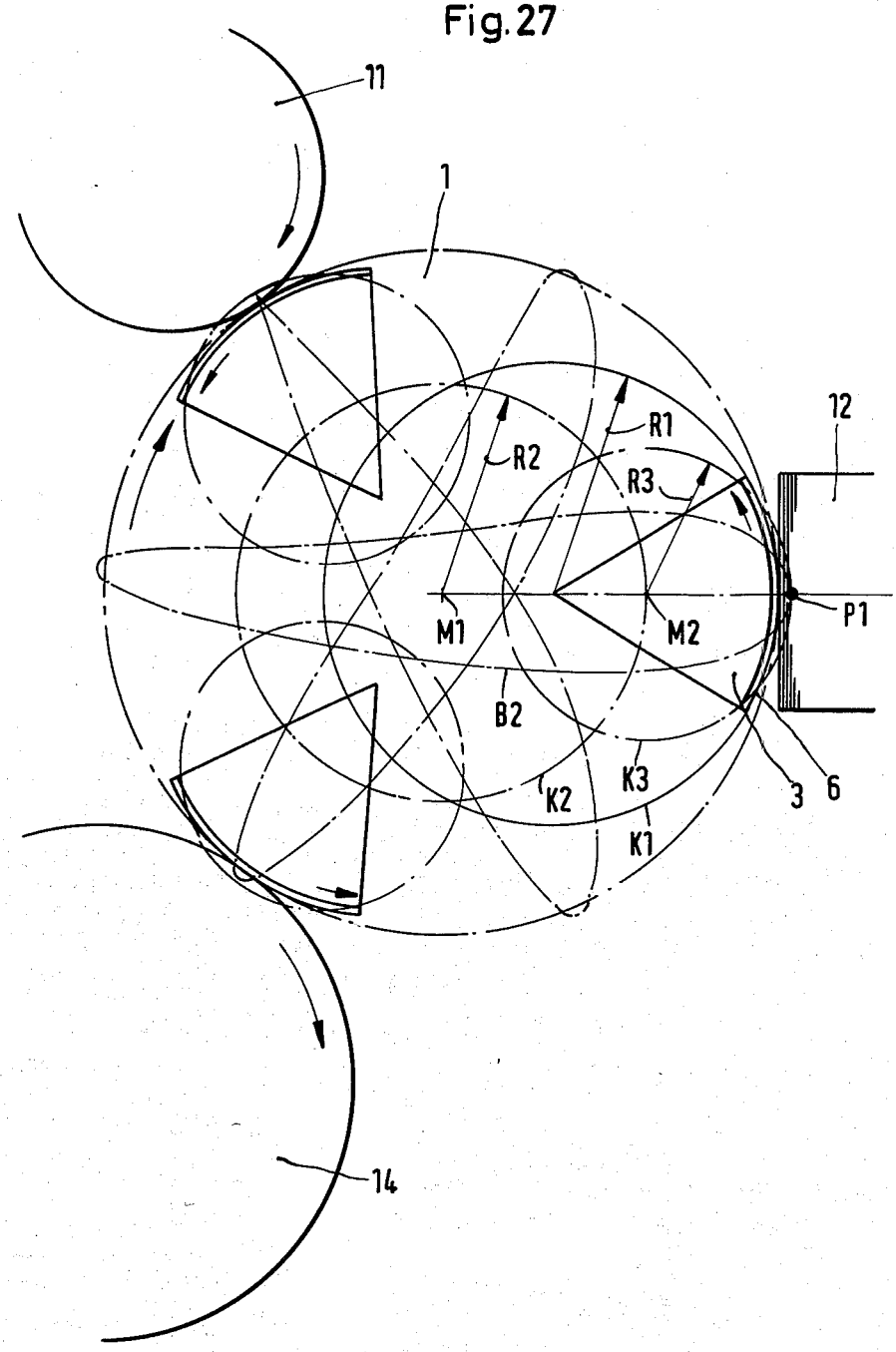
Figure 28:
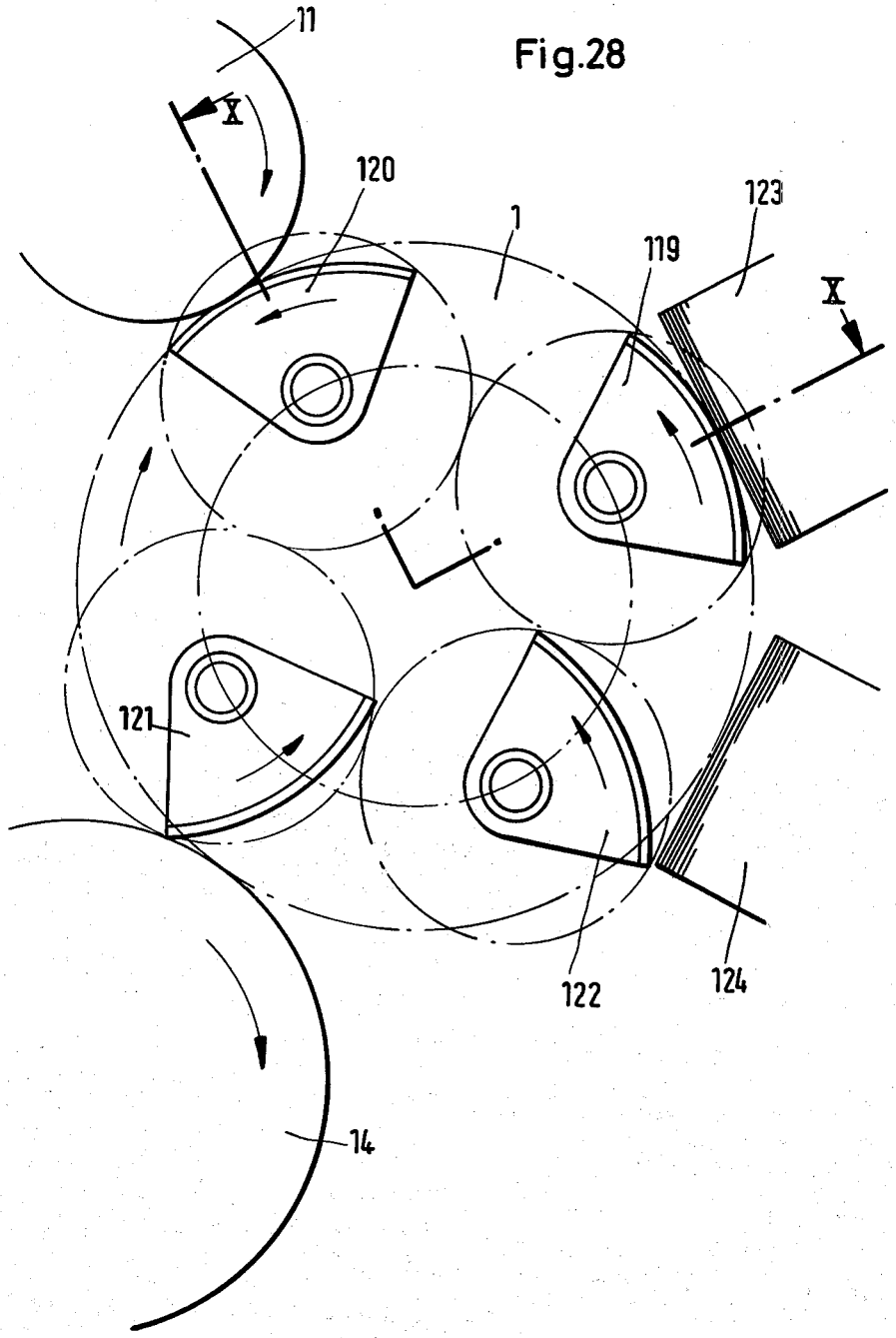
Figure 29:
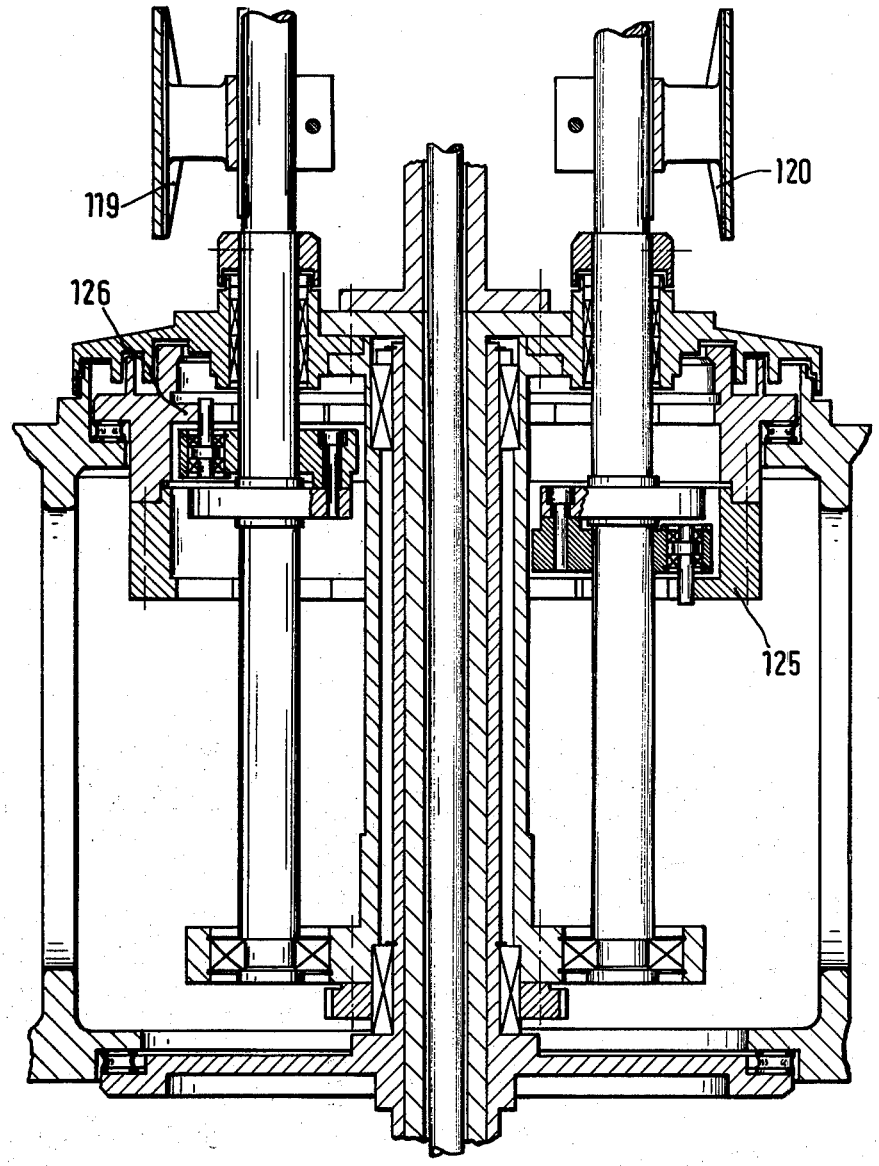
Figure 31:
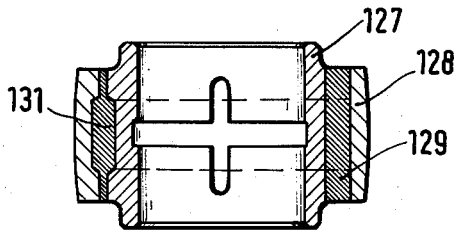
Figure 30:
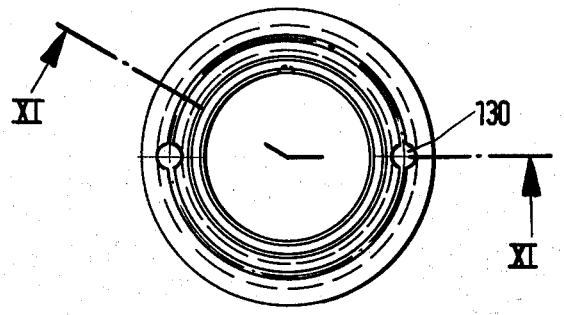
Figure 32:
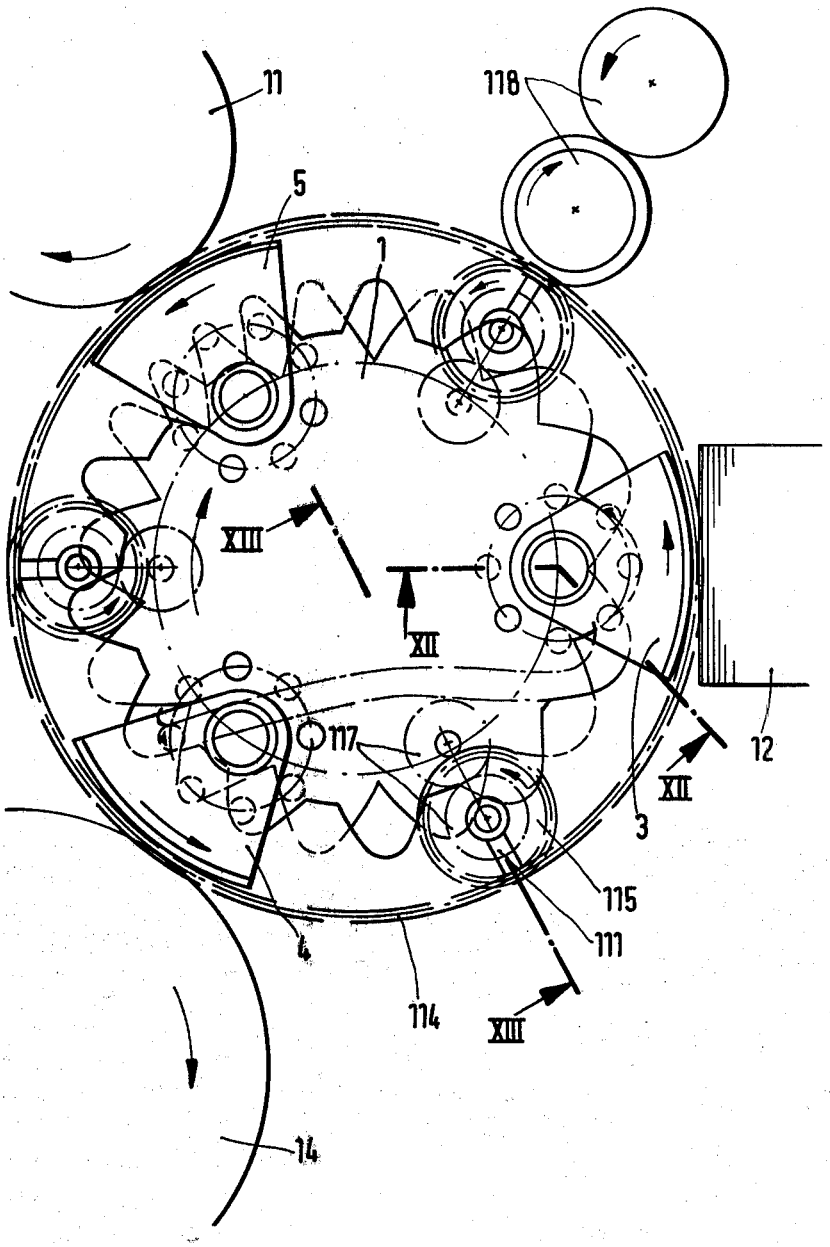
Figure 33:
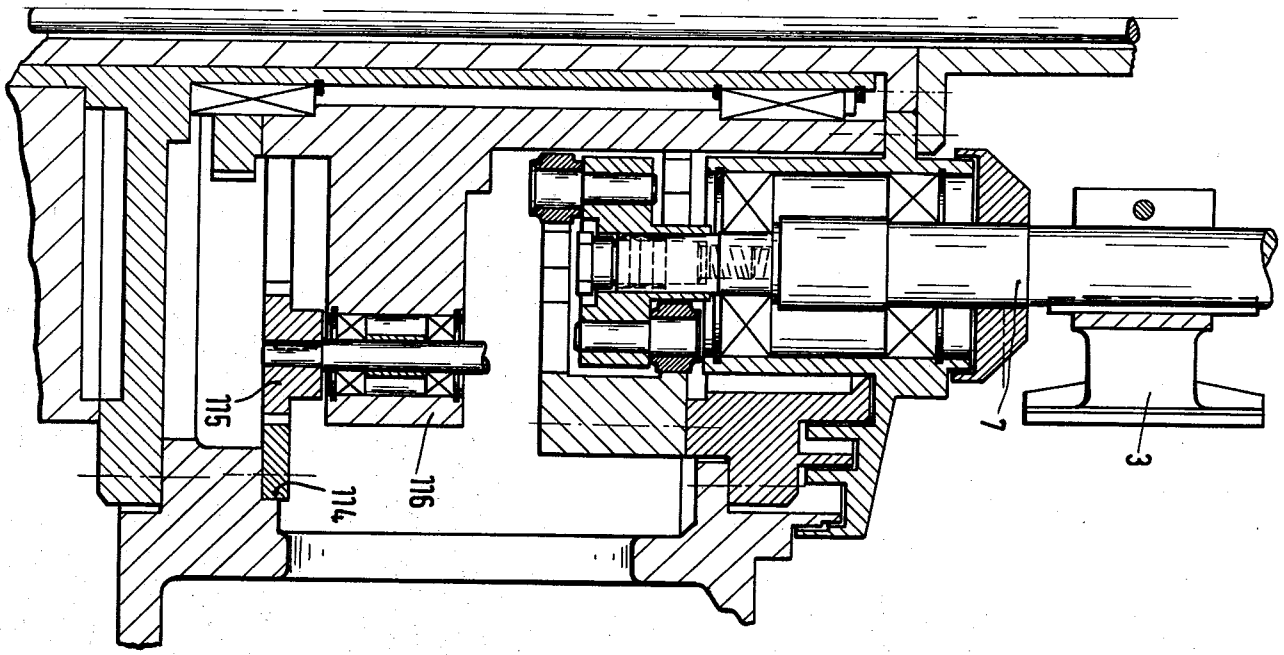

FIG. 17 schematically illustrates the track of a point on the orbit radius of lanterns during travel from the adhesive-application station to the label-storage station in the machine of FIG. 16;

FIG. 18 schematically illustrates the lantern gearing teeth for controlling the movement of a selector component at each of the adhesive-application station and label-storage stations in the machine of FIG. 16;

FIG. 19 schematically illustrates the track of the center points of the lanterns;

FIG. 20 illustrates a plan view of a sun-wheel for a labelling machine according to FIG. 2;

FIG. 21 illustrates an enlarged view of a section of the sun-wheel lantern gearing of FIG. 20 in the area of the adhesive-application roller;

FIG. 22 illustrates an enlarged view of a section of the sun-wheel lantern gearing according to FIG. 20 in the area of the gripper cylinder;

FIG. 23 illustrates a section of the lantern gearing of two superimposed sun-wheels for a labelling machine according to FIG. 5;

FIG. 24 illustrates a tooth in the lantern gearing teeth according to FIG. 23 with a reduced peak;

FIG. 25 schematically illustrates a modified labelling machine with a sun-wheel, a lantern gear set for each selector component and a transmission drive interposed between the lantern gear set and the selector component in accordance with the invention;

FIG. 26 illustrates a half axial section taken on line IX—IX of FIG. 25;

FIG. 27 schematically illustrates the track of the center points of the lanterns for the machine of FIG. 25;

FIG. 28 schematically illustrates a labelling machine with two label storage stations in accordance with the invention;

FIG. 29 illustrates an axial section taken on line X—X of FIG. 28;

FIG. 30 illustrates a plan view of a lantern roll in accordance with the invention;

FIG. 31 illustrates a view taken on line XI—XI of FIG. 30;

FIG. 32 illustrates a view similar to FIG. 8 of a labelling machine with marking tools in accordance with the invention; and FIG. 33 illustrates a half axial section taken on line XII—XII in the upper part and line XIII—XIII in the lower part of the labelling machine of FIG. 32.

The labelling machine represented schematically in FIGS. 1 to 31 consists of a plate-shaped carrier 1, on which three identical selector components 3, 4, 5 are arranged at the same angles. Each selector component 3 has a cylindrically curved reception surface 6 for a label and pivots in bearings between this reception surface 6 and the center of curvature 2 of the surface 6 by means of a drive shaft 7 in the carrier 1. On rotating the carrier 1 in the direction of arrow 8 (see FIG. 1), the selector components 3–5 are caused to rotate by means of a further drive to be described.

Figure 1:
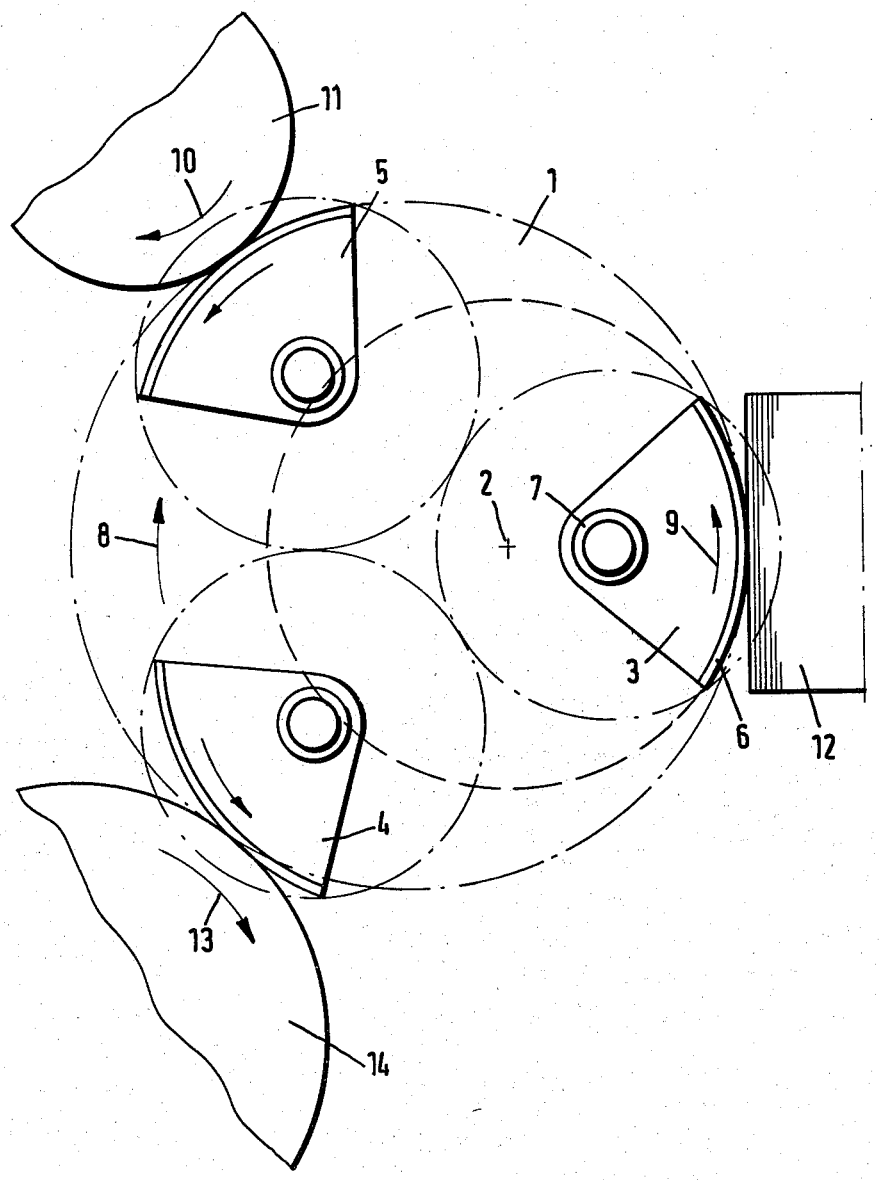
FIG. 1 illustrates a schematic view of a labelling machine in accordance with the invention.

Referring to FIG. 1, on rotating the carrier 1, the selector components 3, 4, 5 are swept past various stations, namely an adhesive-application station 11 at which an adhesive-application roll is mounted for rotation according to arrow 10, a label-storage station 12 at which a fixed label container with a label stack is mounted and a label transfer station 14 at which a gripper cylinder is mounted for rotation in the direction of arrow 13. Each selector component 3, 4, 5 is moved so as to have a rolling contact movement of the reception surface 6 at each individual station 11, 12, 14. In this matter, the reception surface 6 of a selector component 3–5 is first coated by the adhesive application roll 11. Next, on rolling past the label container 12, the front label is picked up from the stack within the label containing 12 onto the reception surface 6 by the effect of the adhesive. On further rotation of the carrier 1, the label is fed to the gripper cylinder 14 which lifts the label from the reception surface 6. In order to ensure rolling contact of the reception surface 6 of each selector component 3–5 at the various stations 11, 12, 14, it is necessary to ensure the acceleration and the deceleration of each selector component 3–5 in the direction indicated by the arrow 9. For this purpose, a common drive in the form of a planetary gear transmission is provided for selector components 3–5.

The planetary gear transmission is explained with reference to FIGS. 2 to 4. The transmission consists of a fixed internally toothed sun-wheel 15 and a planetary gear 16 fixed to the drive shaft 7 of each selector component 3. The planetary gear carries five staves (i.e. lanterns) 17 to 21 at the same angle which are, in turn, fitted so as to rotate on the planetary gear 16 (FIG. 3).

Figure 3:
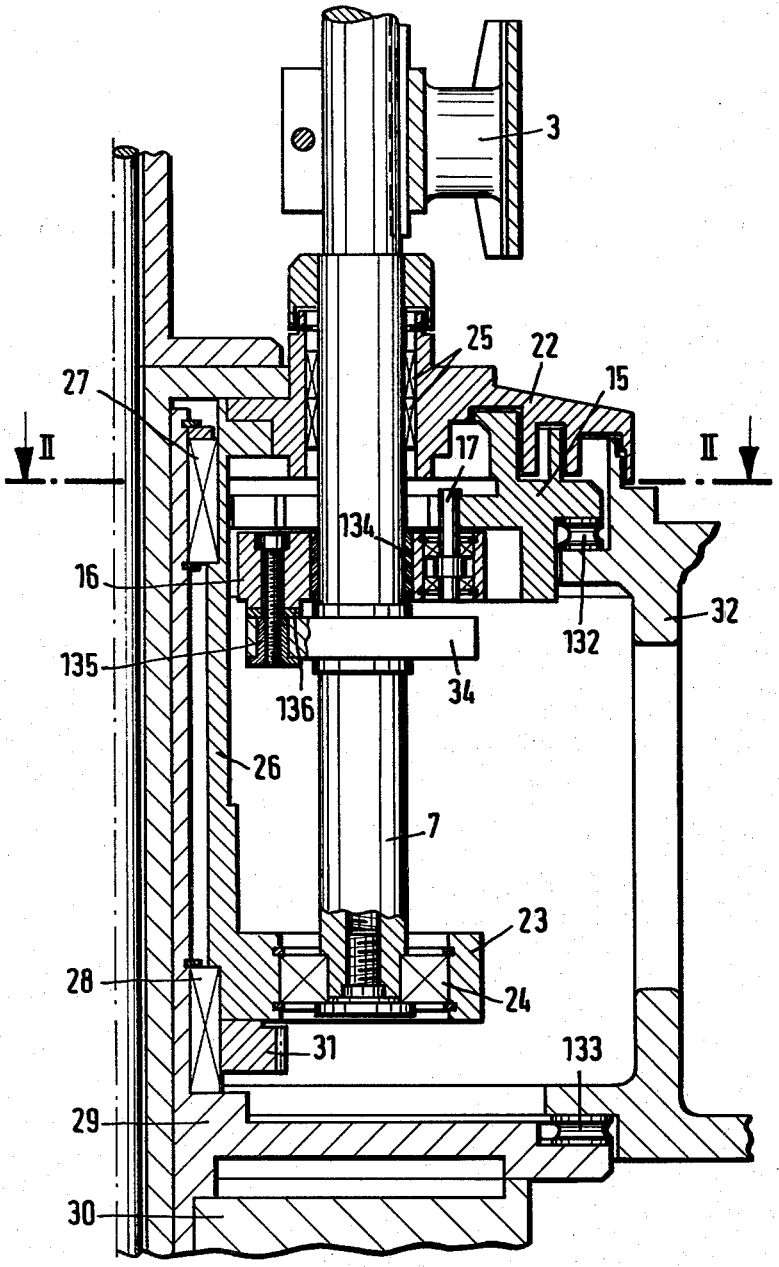
FIG. 3 illustrates a half axial section taken on line I—I of FIG. 2.

The drive shaft 7 of a selector component 3 is fitted so as to rotate in bearings 24, 25 in the upper part 22 and in the lower part 23 of the carrier 1 as shown in FIG. 3. Both parts 22, 23 of the carrier 1 are borne by a shell 26, arranged to rotate in bearings 27, 28 on a central stand 29 of the machine frame 30. A gear wheel 31 is also flanged on to the shell 26 to mesh with a drive pinion (not shown) on a central drive (not shown). This gear wheel 31 initiates the rotary movement of the carrier 1.

The machine frame 30 also has a housing 32 bearing the internally toothed sun-wheel 15. The teeth of the sun-wheel form a lantern gearing 33 in which the planetary gear 16 meshes. The planetary gear 16 is also flanged onto a drive 34 secured to the drive shaft 7.

The planetary gear 16 need not be fitted directly on the drive shaft 7 identical with the bearing shaft; the gear 16 can, for instance, be fitted to an additional drive shaft, coupled by means of a pair of gears with the bearing drive shaft 7.

Figure 6:
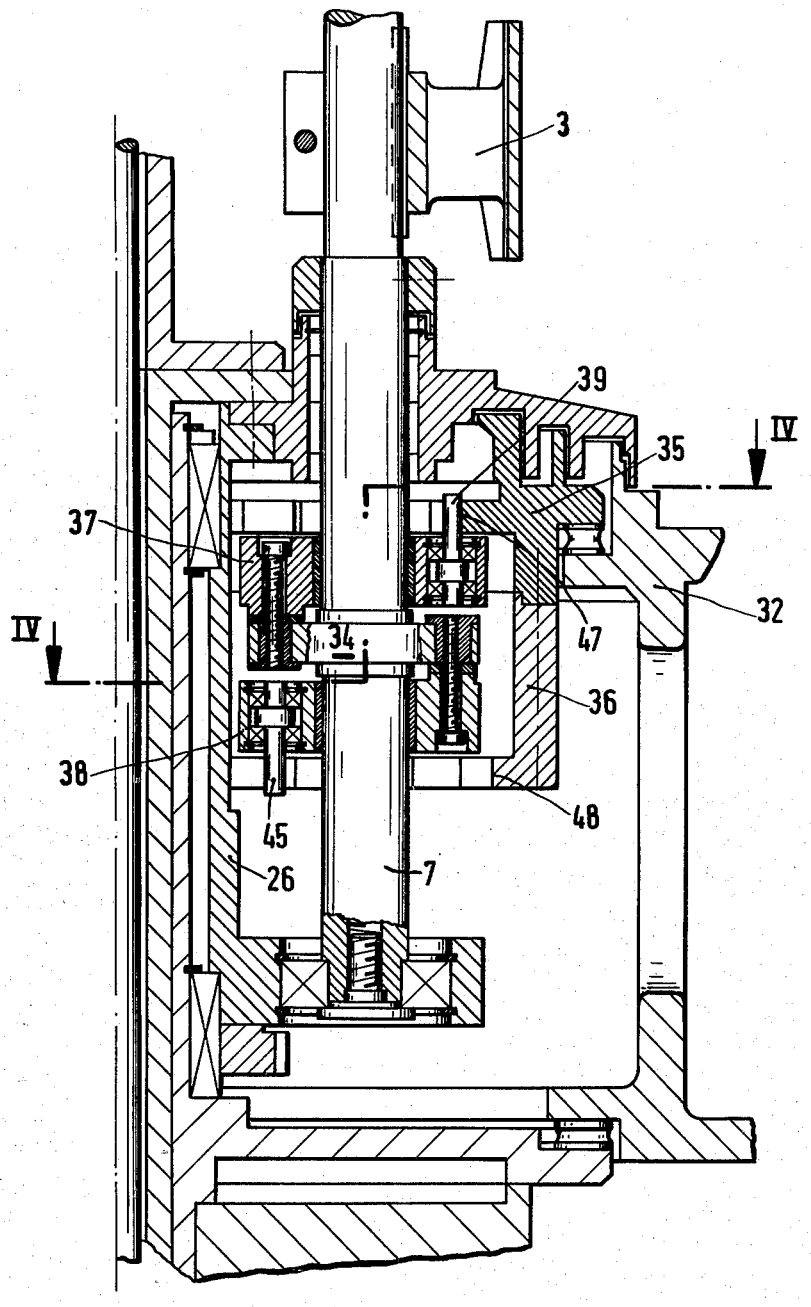
FIG. 6 illustrates a half-axial section taken on line III—III of FIG. 5.
Figure 7:
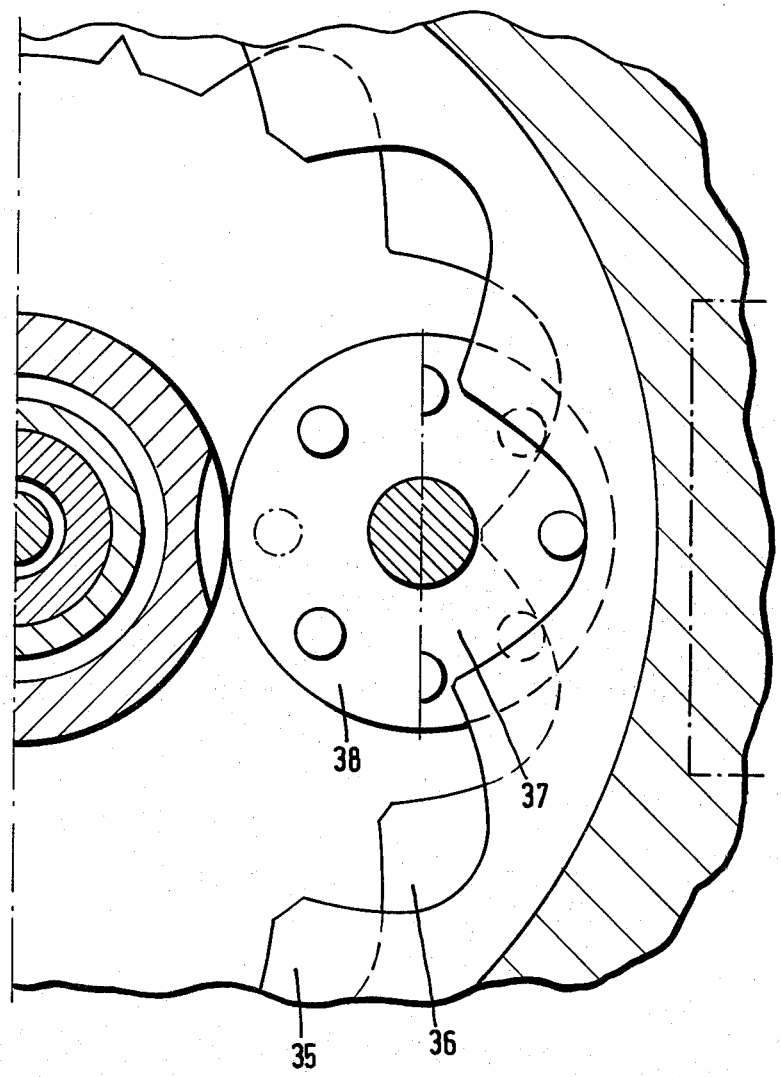
FIG. 7 illustrates a half section taken on line IV—IV of FIG. 6 of the labelling machine in FIG. 5.

Referring to FIGS. 5 to 7, wherein like reference characters indicate like parts as above, the planetary gear transmission may be of an alternative construction. For example, as shown, the transmission includes an internally toothed sun-wheel 35, 36 at two levels on the housing 32 and two planetary gears 37, 38, each with four lanterns 39 to 46, flanged onto the drive 34 located on the drive shaft 7. The teeth of the lantern gearings 47, 48 of both sun-wheels 35, 36 are arranged in gaps in relation to each other.

Figure 9:
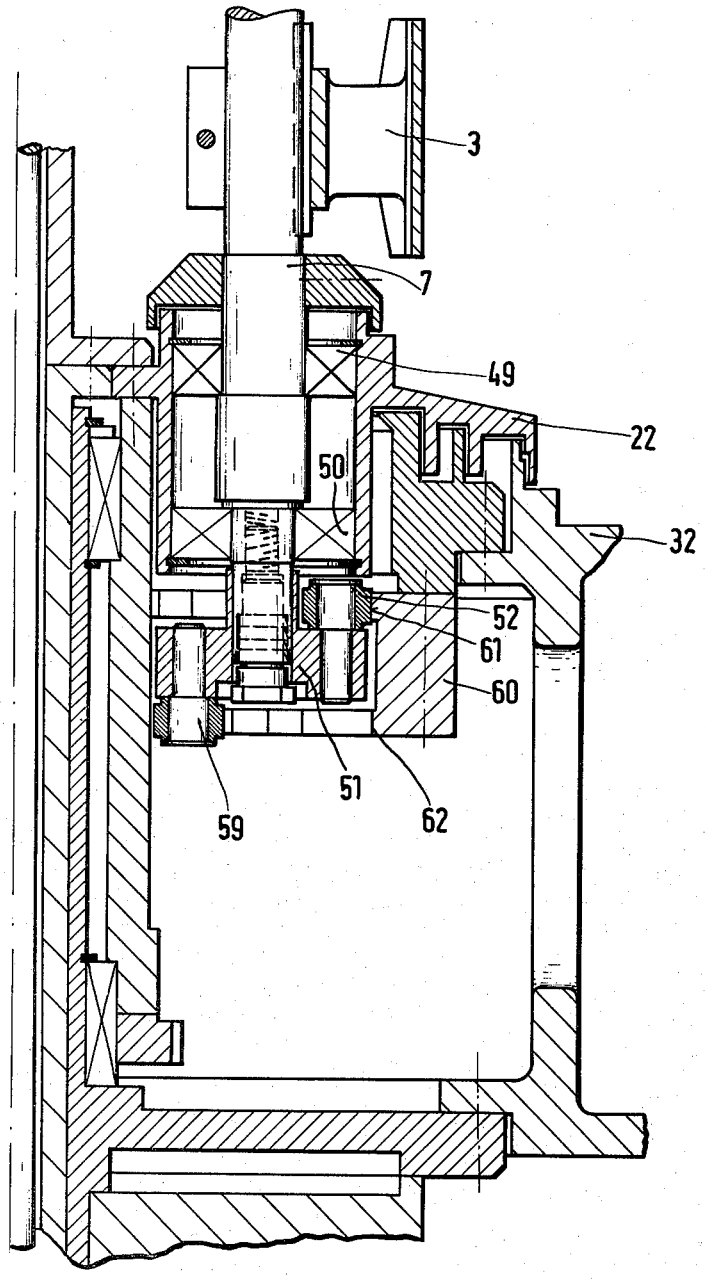
FIG. 9 illustrates a half-axial section taken on line V—V of FIG. 8.

Referring to FIGS. 8 and 9, the planetary gear transmission may also be constructed in a manner which differs from that in FIGS. 5 to 7 particularly in that the drive shaft 7 is carried in two bearings 49, 50 exclusively in the upper part 22 of the carrier 1 above the lantern gear sets (i.e. the drive staves 52–59). In this way, both lantern gear sets 52–59 can be fitted to the free lower end of the drive shaft 7.

A further difference in relation to the aforementioned examples, lies in the fact that the drive 34 and the planetary gears 37, 38 of the previous construction are grouped into a single planetary gear 51, carrying at top and bottom the two lantern-gear sets each consisting of four lanterns 52 to 59. Also, a one-piece sun-wheel can be provided with two lantern gearings 61, 62.

The arrangement of the planetary gear 51 on the lower free end of the drive shaft 7 allows the lower lantern-gearing 62 of the one-piece sun-wheel 60 to be located on a plane beneath the free end of the drive shaft 7. As a result of this arrangement, the teeth peaks of the lantern-gearing 62 may be fully formed as shown in FIG. 8, contrary to the teeth of the lantern gearing 61, of which the peaks must be removed since the drive shaft 7 runs in that area. This means better guidance (greater coverage, overlapping) of the lanterns 52 to 59.

A further difference, which may also be implemented with other examples as described or still to be described, lies in the fact that the lanterns 52 to 59 are in the form of rollers.

Referring to FIGS. 10 to 15, the planetary drive may alternatively have planetary gears located on the lower free end of the drive shaft 7 with lanterns located on the underside.

Figure 10:
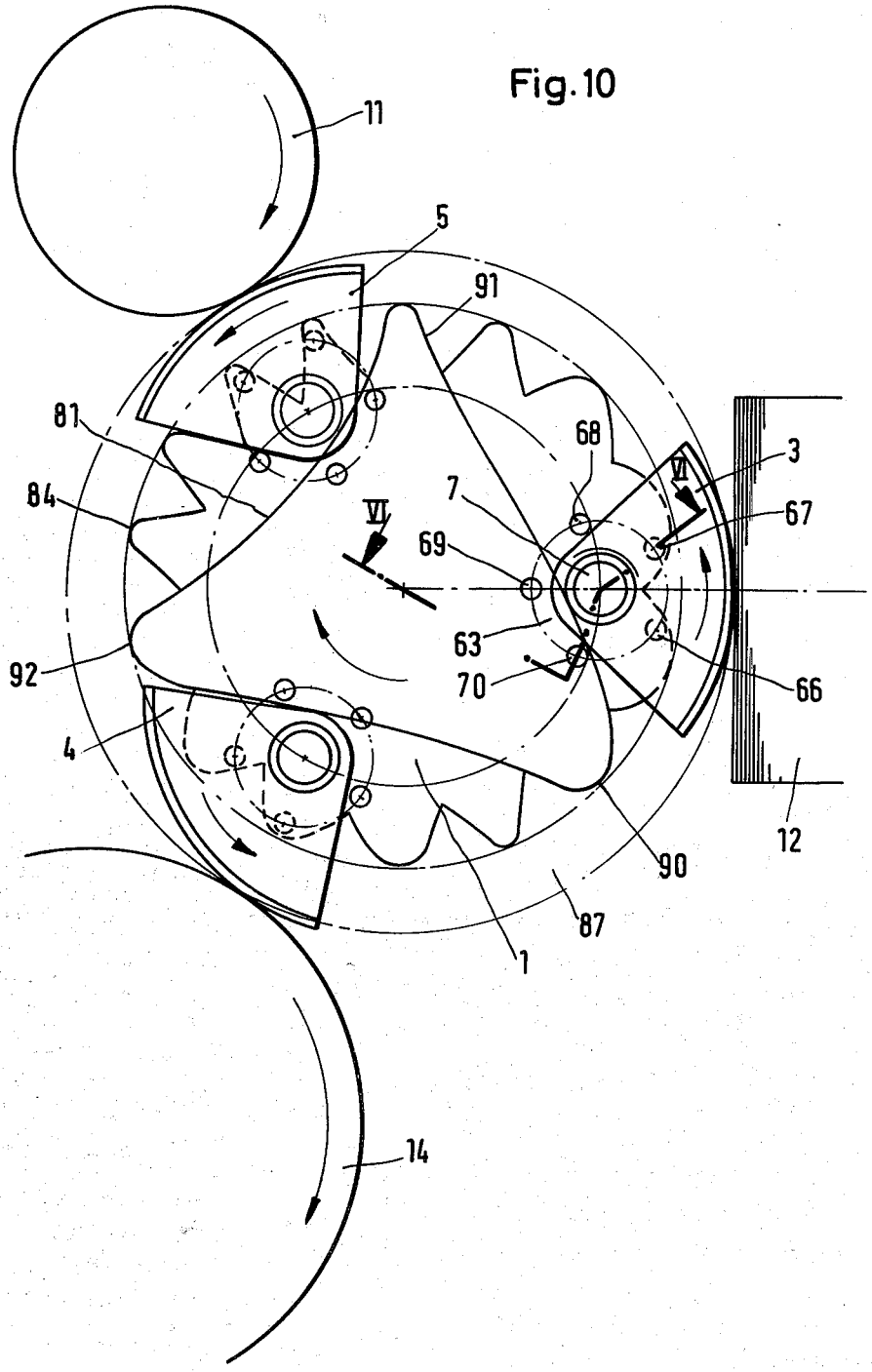
FIG. 10 illustrates a labelling machine as in FIG. 1 in schematic form with one sun-wheel and one lantern for each selector component extending behind a sun-wheel and remaining lanterns of the same lantern gear set, meshing with the sun-wheel.
Figure 11:
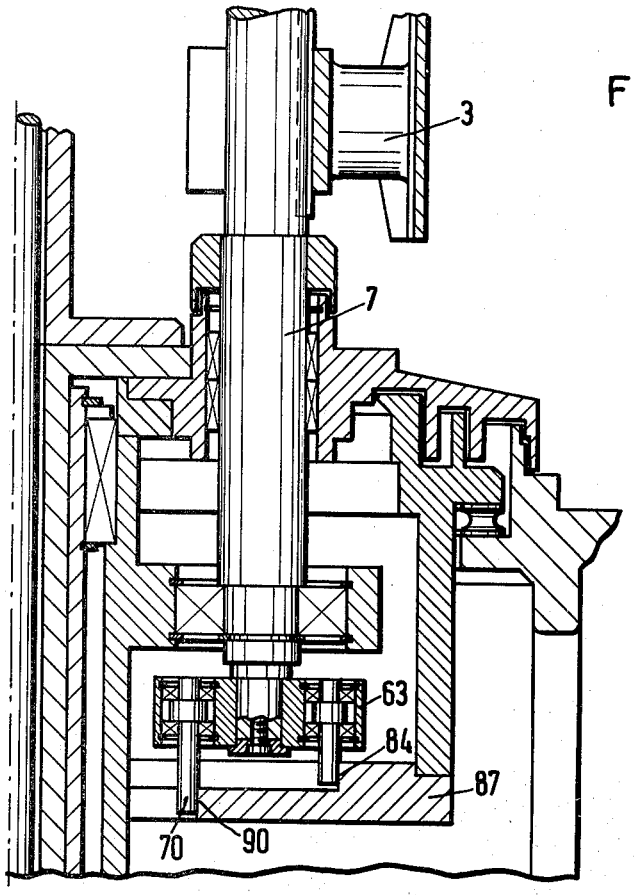
FIG. 11 illustrates a half-axial section taken on line VI—VI of FIG. 10.

As shown in FIGS. 10 and 11, the planetary gear 63 has five lanterns 66–70 which can mesh with a toothed lantern gearing 84 on a sun-wheel 87 and which can have one of the lanterns (70) guided along a closed cam track in the form of a surface 81 on the sun-wheel 87. As indicated in FIG. 11, the cam surface 81 encompasses the lanterns 66–70 on a plane offset in relation to the gearing 84. As indicated in FIG. 10, the cam surface follows an essentially triangular track.

Figure 13:
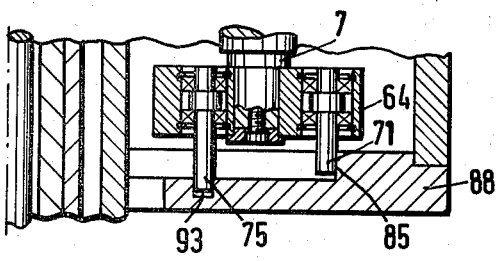
FIG. 13 illustrates a half axial section taken on line VII—VII of FIG. 12, exclusively in the area of the planetary wheel and sun-wheel of the design for a labelling machine according to FIG. 10.
Figure 14:
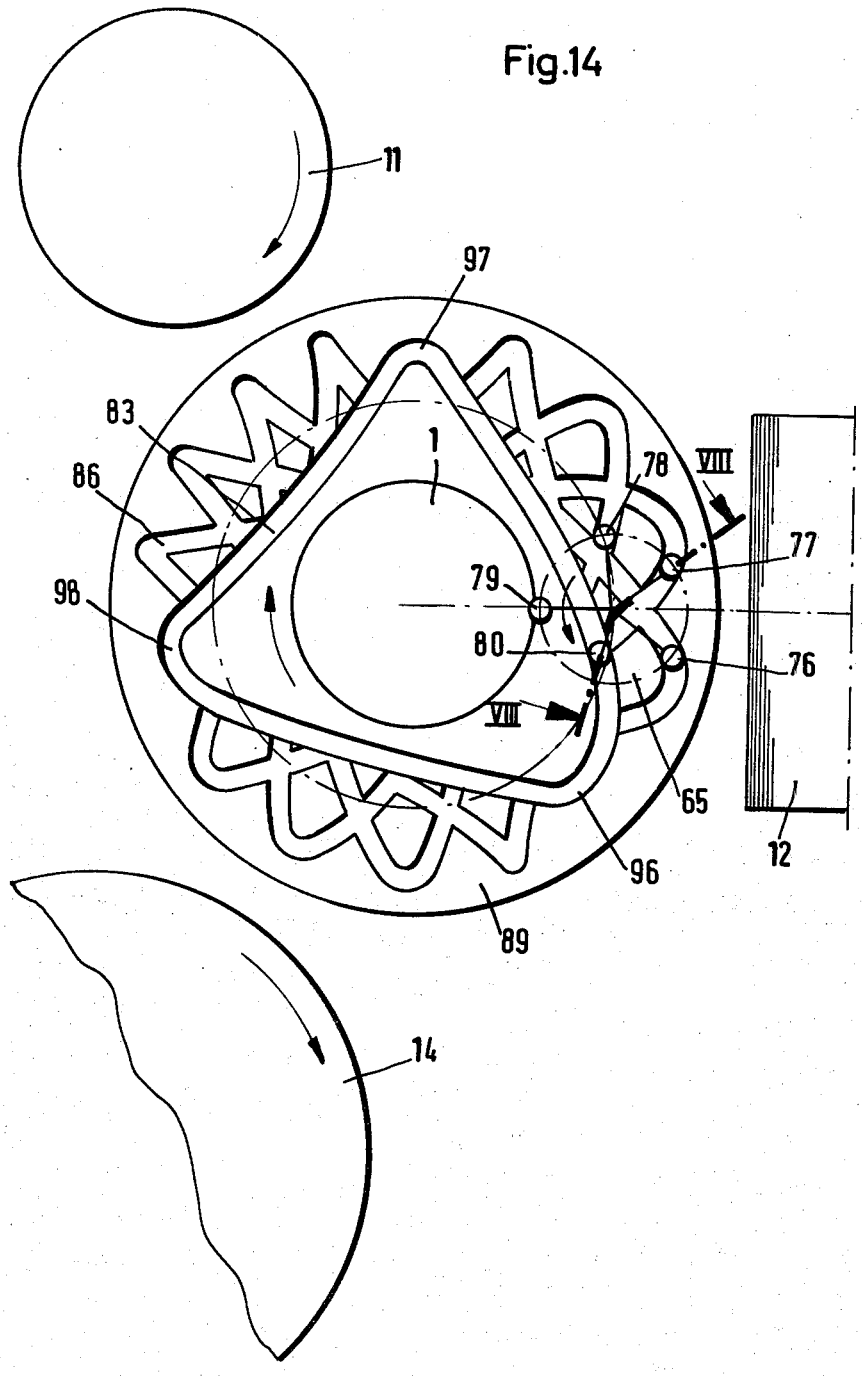
FIG. 14 illustrates a schematic view of a labelling machine as in FIG. 1 with a similar construction to FIGS. 10 and 12.

As shown in FIGS. 13 and 14, the planetary gear 64 has five lanterns 71–75 meshing with a toothed lantern gearing 85 on a sun-wheel 88 with one lantern (75) guided within a cam track in the form of a groove 82 of essentially triangular shape in the sun-wheel 88.

Figure 15:
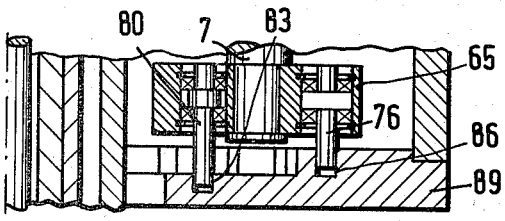
FIG. 15 illustrates a half axial section taken on line VIII—VIII of FIG. 14.

As shown in FIGS. 15 and 16, the planetary gear 65 has five lanterns 76–80 meshing with a toothed lantern gearing 86 formed as part of a groove in a sun-wheel 89 with one lantern (80) guided within a cam track in the form of a groove 83 of essentially triangular shape in the sun-wheel 89. As shown, the groove 86 has a plurality of cross-intersecting groove sections.

Figure 12:
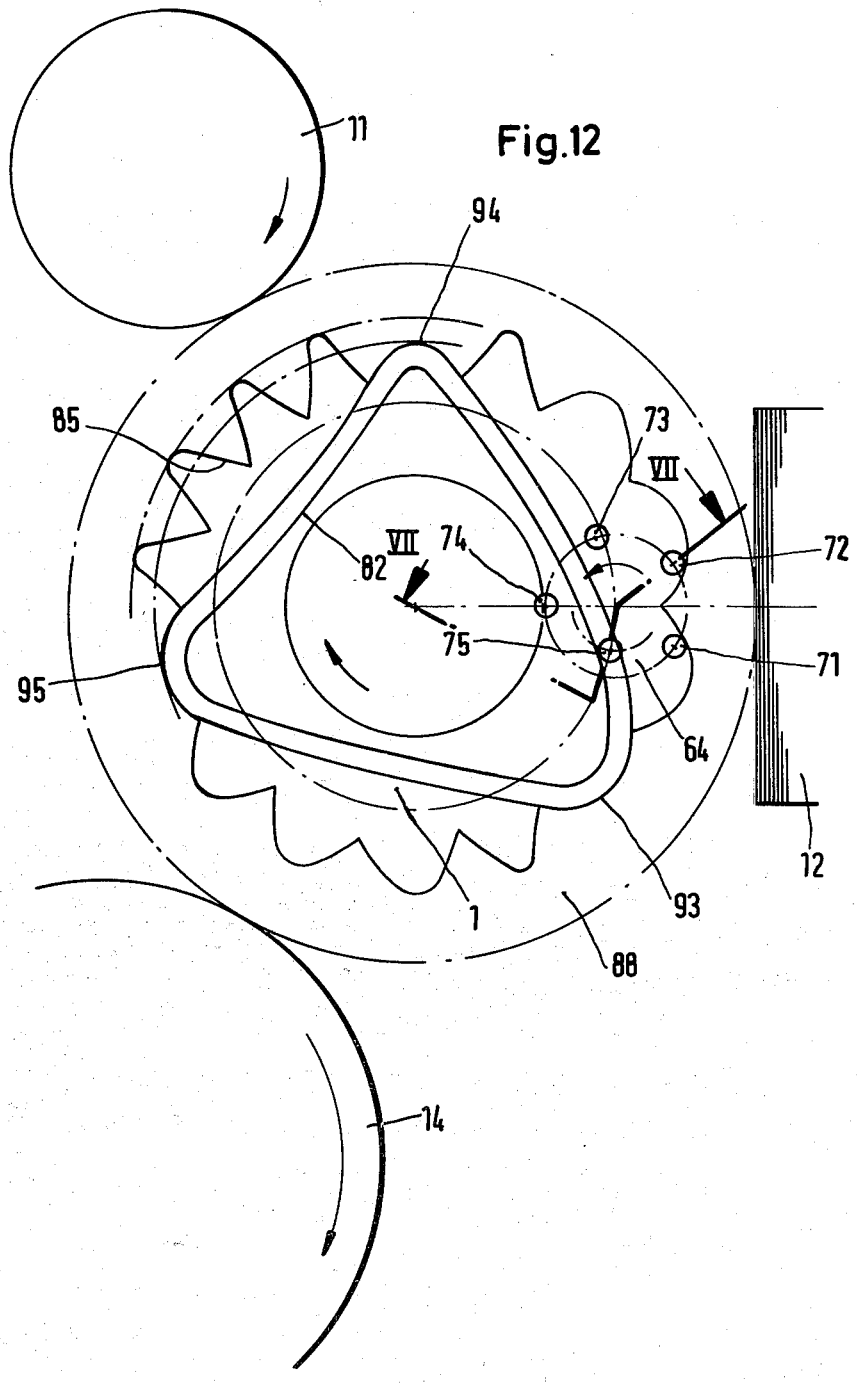
FIG. 12 illustrates a schematic view of the labelling machine according to FIG. 1 in a similar construction to FIG. 10.

As indicated in FIGS. 10, 12 and 14, the lantern gearing 84 to 86 is interrupted in the area of the peaks 90 to 98 of the uninterrupted cam tracks 81, 82, 83. The missing teeth at those points are replaced by the peaks 90 to 98 of the cam tracks 81 to 83. As the cam tracks 81 to 83 are at a lower level than the lantern-gearing 84, 85, 86, it is necessary for the relevant lantern 70, 75, 80 to be extended.

In FIGS. 10 and 11, the curved surface 81 is open just as is the lantern gearing 84 towards the carrier center, so that the relevant lantern 70 is only guided on one side.

FIGS. 12 and 13, the uninterrupted curved groove 83 guides the relevant lantern 75 on both sides. In order to retain the guidance at the peaks 93 to 95 also, these are flattened as compared with the peaks 90 to 92 of FIGS. 10 and 11. Without this flattening, the inner guide edge of the groove 83 would have to spring back too far at the peaks. The flattening of the groove 83 at peaks 93 to 95 is effected, so that the relevant lantern gear 75 is located on a smaller orbit than the remaining lanterns 71 to 74.

In FIGS. 14 and 15, the lantern gearing 96 is not open towards the carrier center, but consists of groove sections. The twin-guiding thus achieved ensures better coverage (overlapping) of the lanterns. Therefore with five lanterns there are always three to four lanterns in mesh.

Referring to FIGS. 16 to 19 various geometric features are shown, which contribute towards improved operation of the labelling machine as described, such as reduced noise, wear and more compact design.

According to FIGS. 16 and 17, the geometric ratios of the labelling machine are selected in such a manner that the center point M1 of the carrier 1 lies within the circle K1, inscribed in the central position of the selector component 3 before the rolling contact plane of the label container 12, to cover the reception surface 6 of the selector component 3. The geometry is also thus arranged, so that the radius R2 of the orbit K2 of the center-point M2 of the planetary gear 16 is smaller than the curvature radius R1 of the reception surface 6 of the selector component 3 and greater than twice the radius R3 of the orbit K3 of the lanterns. Finally, the geometry of individual parts of the labelling machine should be arranged in such a way, that point P1 on the orbit K3 of the lanterns having the shortest distance from the rolling contact plane before the rolling contact level of the label container 12, with the selector component 3 in the central position, will travel along a track B1 as indicated in dotted line (in FIG. 16) from the adhesive-application roller 11 to the label container 12 and further to the gripper cylinder 14. This track B1, starting from the adhesive roller 11, changes from an initially concave to a convex course, being convex in the area of the label container 12 then going from convex to concave in the area of the gripper cylinder 14. The turning points W1, W2 (FIG. 17) of the track B1 should be such that the turning tangents T1, T2 intersect each other behind the rolling contact level at a point P2 within the station 12. Angles $\alpha 1$, $\alpha 2$, enclosing the tangents T1, T2 with a straight line G passing through the center-point M1 of the carrier 1 and through point P1 of the orbit K3, should be between 12 and 24 degrees. The angles $\alpha 1$, $\alpha 2$, may differ from each other. The geometrical ratios are independent of the angular position of the lantern-gear teeth of the sun-wheel, i.e. the teeth peaks on the straight line G may also be close thereto, as long as the required acceleration and deceleration conditions of rotation allow suitable steepness of teeth flanks.

The ratios of the radius R1 of curvature of each selector component surface 6 to the orbital radius R3 of the lanterns is from 2.2 to 5.2. Further, the radius R1 and the radius R2 of the orbit K2 of the planetary gear are each 100 to 130 mm and the orbital radius of the lanterns is 25 to 45 mm.

FIG. 18 shows the sub-division ratio of lantern-gearing teeth for the central range of the adhesive roller 11 and the central range of the label storage station 12. For the same angle of rotation (30 degrees) of the carrier 1 to the adhesive roller 11 and to the label container 12, the rotation ratio of the selector component is 1.5:1. The ratio of teeth density for the adhesive roller 11 and the label container 12 is inversely proportional thereto. The division ratio of the lantern gearing is 1:1.2 to 1:1.8 on the adhesive application roll 11 and the label storage station 12 while the transmission ratio of the planetary gear is 1:3.8 to 1:5 on the adhesive application roll 11 in a central position and 1:2 to 1:2.6 at the label storage station 12 in a central position.

FIG. 19 shows the center-point travels of the lanterns and emphasizes that the lanterns close to the intersection points in the area of the label container 12 are outside the orbit K2 of the center-point M2 of the planetary wheel, and within the range of the adhesive roll 11, they are inside the orbit K2 of the center-point M2 of the planetary wheel.

Bearing in mind the above geometric conditions, a labelling machine is preferably of the following dimensions:

R1=242 mm, R2=104 mm, eccentricity=52 mm, adhesive-roller diameter=160 mm, gripper cylinder diameter=260 mm, label length=105 to 240 mm.

With such dimensions and a constant angular speed of the carrier 1, the transmission function of the second order $$\frac{w}{w^2} = \frac{\text{rad/sec}^2}{\text{rad}^2/\text{sec}^2} = \frac{\text{rad}}{\text{rad2}}$$

for a label length of 105 mm will not exceed a value of 1.3 (rad/rad$^2$) and a label length of 240 mm will not exceed a value of 2.7 (rad/rad$^2$). These values are naturally not achieved in all positions in relation to each other. In the event of an angle enclosed by two adjacent stations, for which the component reaches a specific rotation with excessive acceleration peaks at the selector component, these can be reduced by increasing the angle.

The above described geometric conditions are independent from whether a single sun-wheel with a lantern gearing set or two sun-wheels with relevant gearing sets are used to drive one or each selector component. As shown by the described examples, the steepness of the teeth flanks of the lantern gearing 22 of the sun-wheel 15 (see FIG. 20) and the density of teeth at the individual stations 11, 12, 14 tends to differ. Where the greatest angular speed in rotation of the selector component 3 is required—e.g. at the adhesive roller 11 where the reception surface 6 sweep has the smallest angle of curvature during the roller contact operation—the teeth sequence is at its most dense; whereas it is less dense, where the angular speed of rotation of the selector component is at its lowest—e.g. at the label container 12, where the reception surface contact rolls along a straight line.

As a result of the teeth sequence which is selected, their steepness and other geometric dimensions of the labelling machine, it is possible, for a uniform rotation of the carrier 1 in the direction of the arrow 8, for each selector component 3 to have a rotation in the direction of the arrow 9, which is practically slip-free at the reception surface 6 of the individual stations 11, 12, 14. The selector component 3 is consequently accelerated and decelerated in its own rotation movement.

Figure 4:
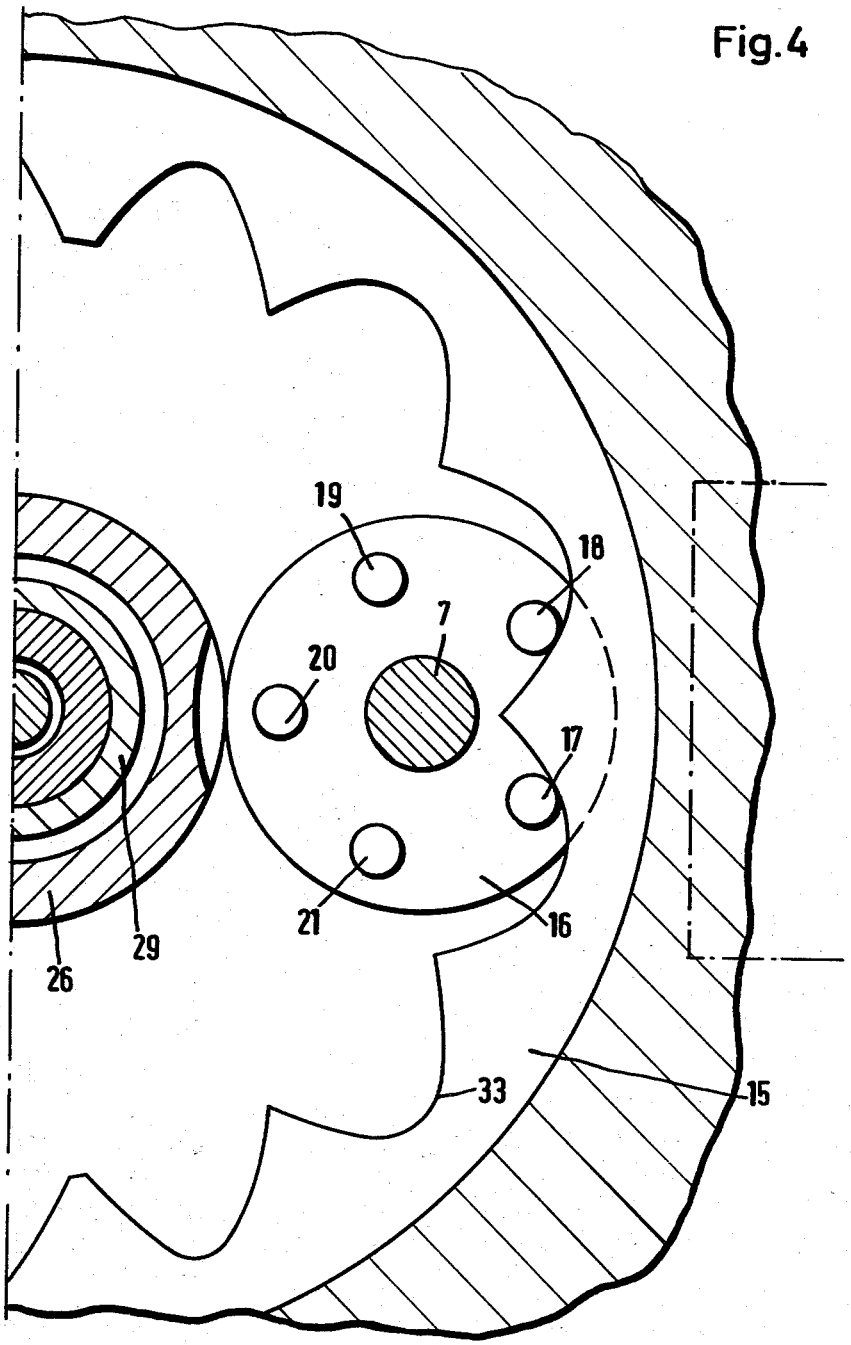
FIG. 4 illustrates a half section taken on line II—II of FIG. 3 of the labelling machine in FIG. 2.

Basically, the accelerated and decelerated rotation of the selector component can be implemented by means of a single sun-wheel and a planetary wheel, as shown in FIGS. 2 to 4. In this case, sufficient coverage is still available at critical points, i.e. two lanterns remain in mesh, and the teeth are still wide enough at other critical points of the adhesive roller. An improved coverage with wider teeth is achieved nonetheless, when each selector component has two lantern-gear sets, meshing with the lantern gearing of two sun-wheels having their teeth arranged in gaps as shown in FIGS. 5 to 9. The examples in FIGS. 10 to 15 show solutions, whereby an improved coverage may also be achieved with a single set of lanterns.

As shown in FIG. 20 for all examples, the teeth of the internal gearing of a given sun-wheel 15 are at their most dense, wherever the greatest angular speed is required in the rotation of the selector component; the example shows the station with the smallest curvature radius, i.e. the adhesive roller 11, with the shortest reception face. The modulus (density) of teeth and the radius of the orbit of the lanterns (distance between lanterns and drive shaft) are selected so that teeth shapes are able to mesh and operate without looping of the lantern pattern (no undercuts). This means that the lanterns maintain their direction of rotation during the contacting of teeth flanks. This has a favourable effect on wear and noise formation. FIG. 21 shows a tooth in dotted lines with convex flanks and free from undercut in the area of the adhesive roller 11, where an undercut was originally required at the earliest due to the movement of the assembly. Such teeth shapes are nevertheless not only used in the areas of relatively small diameter adhesive rollers 11, but also in the area of gripper cylinders 14 (FIG. 22) where a small diameter is required.

Although the lanterns mesh with the teeth gaps at a relatively flat angle, the entrance particularly in the area of concave teeth flanks, i.e. specially in the area of the label container, can be further improved, by the fact that non-bearing teeth peaks on the lantern-gearing are flattened.

FIG. 23 shows the bearing areas of teeth flanks, by means of a dotted line located behind the teeth flanks. The enlargement in FIG. 24 shows very particularly the smooth entrance of lanterns favored by the flattening of teeth peaks, whereby the dotted line is the mathematically calculated pattern of teeth flanks according to the law of movement. It should be pointed out that the flattening of teeth peaks can be implemented not only with double sun-wheels, but also in the case of single sun-wheel applications.

Whereas the selector components of the above examples are directly driven by the relevant planetary gears, the drive in FIGS. 25 to 27 shows a drive in the form of a transmission gearbox. In this embodiment, the drive for each selector component 3–5 consists of a fixed internally toothed sun-wheel 99 and a planetary wheel 100 with three lanterns 101 to 103 (in the form of rollers) arranged at the same angle. The planetary wheel 100 is fixed to the lower end of a shell 104. The shell 104 rotates on the lower free end of the drive shaft 105 and is set in bearings in a plate 106 on the carrier 1. The drive shaft 105 of the selector component 3 is coupled rigidly by means of a transmission box consisting of a fixed gear 107 on the shell 104 and a fixed gear 108 on the drive shaft 105. Both gears 107, 108 are rigidly connected by means of a gear pair 109 located so as to rotate in bearings in the upper part of the carrier 1 and in the plate 106. As a result of this coaxial setting of drive shaft 105 and shell 104, a compact construction is achieved for the transmission assembly.

As already described with reference to other examples, FIG. 25 also shows that the steepness of the teeth flanks of the sun-wheel and the density of teeth at the various stations may differ. Compared with other constructions without a transmission drive, the sun-wheel 99 has considerably less teeth and less lanterns. The coverage at the critical points in the area of the label container 12 nevertheless remains considerable.

According to FIG. 27, the geometric conditions for the machine are selected so that the center point M1 of the carrier 1 lies within the circle K1, matching the reception surface of the selector component 3 with the selector component 3 in the central position before the rolling contact plane. Furthermore, the geometry is so selected that the radius R2 of circular track K2 of the center-point M2 of the planetary wheel 100 is smaller than the radius of curvature R1 of the reception surface 6 of the selector component 3 and smaller than twice the radius R3 of the orbit 3 of the lanterns 101 to 103. Furthermore, the individual parts of the labelling machine are so constructed, that point P1 on the orbit K3 of the lantern gears 101 to 103, follows a track B2 as indicated in dotted line with the selector component in the illustrated central position before the rolling contact level of the label container 12. The characteristic of this track B2 is that it runs convex on either side of point P1 and intersects the orbit K3. As indicated, the track B2 intersects the orbit K3 before contacting the rolling contact plane of the label storage station 12. With this geometry, very good conditions are achieved for acceleration and deceleration of the rotation of the selector component as well as for compact labelling machine construction.

Insofar as the planetary wheel is located on the lower free end of the drive shaft of the labelling machine (FIG. 26), sufficient space remains in the housing beneath the sun-wheel and planetary wheels, to install a further drive for marking equipment.

Referring to FIGS. 32 and 33, a labelling machine as in FIG. 9 can be provided with marking equipment components 111, 112, 113 located between the respective selector components 3, 4, 5 and their drives. Each marking component 111–113 is fitted in bearings so as to rotate in the upper part 22 of the carrier 1. A fixed sun-wheel 114 meshing with a planetary wheel 115 serves as a drive. The planetary wheel 115 rotates in a plate 116 in the carrier 1. The planetary wheel 115 and the marking component 111 are connected together by means of wheel bridges 117 (FIG. 32).

Between the adhesive roller 11 and the label container 12, a color station 118 is located, with a rotating drum and soft facing for inking purposes.

On rotation of the carrier 1, the marking components 111 to 113 together with selector components 3 to 5 execute a rotation. The transmission ratio for the marking components 111 to 113 is so selected that an initially colored stamp at the coloring station 118 is able to mark the front label at the label container 12.

Instead of the planetary gear drive, the marking component can be operated with a cam arrangement in one plane. The marking component may carry an embossing component instead of the punch, and be controlled in such a manner as to emboss the label held upon the selector component reception surface.

Referring to FIGS. 28 and 29, the labelling machine may alternatively be provided with four selector components 119 to 122 and two label containers 123, 124. In this case, the selector components 119, 121 take labels from container 123, whereas selector components 120 and 122 take labels from label container 124. The selector component drive and bearings are as for the example in FIGS. 2 and 3, with the difference that for each pair of selector components 119/121 and 120/122, a sun-wheel 125, 126 is fitted for each one.

In the simplified construction, the lanterns, as shown in most examples, are formed as pegs set in planetary wheels. Nevertheless, one preferred construction is to use rollers. This has great advantages when two lantern gearings are used in a single sun-wheel body, as shown in FIG. 9. In this preferential construction, each lantern (see FIGS. 30 and 31) has a roller consisting of an inner bearing shell 127 and an outer running jacket 128 as well as an insert 129 filling an annular space between the shell 127 and jacket 128. This insert is made of a flexible yielding material with a Shore hardness of 90 to 98 and mounts the jacket 128 on the shell 127. In at least one point but preferably at several points of the periphery, the bearing shell and jacket have indents 130, 131 filled with the insert 129. In this manner, a solid bond is created between the bearing shell 127 and jacket 128 in the axial and peripheral directions. The material of the insert 129 is exposed in this way as little as possible to the agressive effects of oilbath materials, within which the planetary gear normally operates. Also, the clearances between the bearing shell 127 and jacket 128 and both ends are limited to an extent just required for the manufacturing tolerance of the flexible material.

In order to reduce noise, the drive and housing, as shown in FIG. 3, may be insulated by a separation between the sun-wheel 15 and housing 32 and between the machine frame 30 and housing 32 by means of rubber buffers 132, 133. Furthermore, bushes 134 and shells 135 may be used to ensure acoustic disconnection of noises taken outside by the drive shaft 7 in conjunction with intermediate plates 136 for the lanterns.

What is claimed is:

1. In a labelling machine having a frame, a track, and a sequence of stations along said track, said stations including an adhesive-application station, a label-storage station and a label transfer station;

a rotatable carrier disposed within said track;

at least one label selector component mounted on said carrier for rotating in an opposite direction from said carrier, said selector component having an outwardly curved surface for rolling on an adhesive-application roll at said adhesive-application station, for picking-up a label at said label-storage station and for applying the label to said label transfer station; and a planetary drive for rotating said selector component on said carrier, said drive including an internally-toothed sun wheel fixed in said frame and defining a lantern gearing thereon, a drive shaft secured to said selector component and a planetary gear driving said shaft and having a plurality of lanterns carried thereon for meshing with said lantern gearing on said sun wheel, said lantern gearing having teeth at each said station with flanks sloped according to the required acceleration and deceleration of rotation of said selector component for a rolling movement at each said station.

2. A labelling machine as set forth in claim 1 wherein said planetary gear is fixed on a drive shaft orbiting said sun gear on a circular orbit and each lantern orbits said planetary gear on a fixed radius and wherein said circular orbit, said fixed radius, the radius of each lantern, the slope of said teeth flanks and the modulus of said teeth are matched to each other whereby a point on the orbital circle of said lanterns and lying at the shortest distance from said label storage station in a central position of said selector component relative to said label-storage station follows a track changing from concave to convex between said adhesive-application station and said label storage station and between said label storage-station and said label transfer station with tangents at the turning points intersecting at a second point within said label storage station, said first point also following a concave track in the area of said label storage station.

3. A labelling machine as set forth in claim 2 wherein the division ratio of said lantern-gearing is 1:1.2 to 1:1.8 at the central areas of said adhesive-application station having an adhesive-application roll and of said label storage station and the transmission ratio of said planetary gear is 1:3.8 to 1:5 at the central area of said adhesive-application roll and 1:2 to 1:2.6 at the central area of said label storage station.

4. A labelling machine as set forth in claim 2 characterised in that the intersections of the center-point tracks of said lanterns in the area of said adhesive-application roll are on the inside of said orbit of said planetary gear and on the outside in the area of said label storage station.

5. A labelling machine as set forth in claim 2 wherein said label storage station has a rolling contact level at which a label is picked-up by said selector component and wherein said convex track sections intersect said orbit of said lanterns with said selector component in a central position of said contact level.

6. A labelling machine as set forth in claim 2 wherein each tangent defines an angle of from 12 degrees to 14 degrees with a line through said first point and the axis of said carrier.

7. A labelling machine as set forth in claim 6 wherein said carrier axis lies within a circle coincident with said surface of said selector component with said selector component in said central position before said rolling contact level and wherein the radius of the orbit of said planetary gear is smaller than the radius of curvature of said selector component surface and greater than twice the radius of the orbit of said lanterns.

8. A labelling machine as set forth in claim 7 wherein the ratio of the radius of curvature of said selector component surface to the orbital radius of said lanterns is 2.2 to 5.2.

9. A labelling machine as set forth in claim 7 wherein the radius of curvature of said selector component surface and the radius of the orbit of said planetary gear are each 100 to 130 mm and the orbital radius of said lanterns is 25 to 45 mm.

10. A labelling machine as set forth in claim 1 wherein said stations are arranged at differing angles to balance the loading of said sun-wheel in the areas between said stations as related to the center-point of said carrier, the angle between two adjacent stations being contingent upon the acceleration and/or deceleration in rotation of said selector component in said specific angular area.

11. A labelling machine as set forth in claim 1 wherein said teeth flanks of said lantern gearing in the area of one or several of said stations having cylindrically curved rolling contact surfaces are concave and free from undercut.

12. A labelling machine as set forth in claim 1 wherein said planetary gear is fixed on said drive-shaft.

13. A labelling machine as set forth in claim 1 which further comprises a second planetary gear coupled to said shaft and having lanterns thereon meshing with a corresponding lantern gearing of a second internally-toothed sun-wheel secured within said machine frame, and arranged beneath said lantern-gearing teeth of the first sun-wheel and with teeth located in gaps corresponding to said sun-wheel teeth.

14. A labelling machine as set forth in claim 13 wherein each of said planetary gears carries three to five lanterns arranged at the same angle.

15. A labelling machine as set forth in claim 13 wherein said planetary gears are arranged to be rotated and to be locked against each other, in such a manner that any clearance can be removed or prestressing can be induced between said sun-wheels and said drive lanterns.

16. A labelling machine as set forth in claim 13 wherein the lower lantern-gearing is fitted with fully formed teeth points.

17. A labelling machine as set forth in claim 16 wherein said superimposed sun-wheels carrying lantern-gear teeth are located in a channel-formed one-piece body and each said lantern consists of a wear resistant jacket having a flexible yielding insert therein in the form of a composite construction.

18. A labelling machine as set forth in claim 17 wherein the insert has a Shore hardness of 90 to 98.

19. A labelling machine as set forth in claim 17 wherein each flexible insert fills an annular space between said jacket and an inner bearing shell whereby said jacket and bearing shell are securely bonded both peripherally and axially.

20. A labelling machine as set forth in claim 1 wherein the geometrical dimensions of the lantern radius and the modulus of the lantern-gearing teeth and the form of teeth flank are arranged to match whereby two adjacent lanterns mesh with a tooth of the subordinated lantern gearing teeth alternatively between the lanterns engaging said selector component.

21. A labelling machine to claim 1 which further comprises an uninterrupted cam track offset from the level of said lantern gearing of said sun-wheel and having one lantern of said lanterns guided thereon.

22. A labelling machine as set forth in claim 21, wherein said uninterrupted cam track is of essentially triangular shape with points located between said stations.

23. A labelling machine as set forth in claim 21 wherein said uninterrupted cam track is in the form of a groove.

24. A labelling machine as set forth in claim 21 wherein said one lantern guided on said uninterrupted cam track is arranged on a smaller orbital circle than that of the other lanterns.

25. A labelling machine as set forth in claim 21 wherein said lantern gearing is in the form of cross-intersecting groove sections.

26. A labelling machine as set forth in claim 1 wherein said planetary wheel is located at the free end of said drive shaft of said selector component and said lanterns are carried on the underside of said drive shaft, and said lantern gearing teeth of said sun-wheel are located on a level beneath the free end of said drive shaft and having fully formed teeth points.

27. A labelling machine as set forth in claim 1 wherein each lantern is a roller arranged to rotate on said planetary gears.

28. A labelling machine as set forth in claim 1 which further comprises a transmission drive arranged between said planetary gear and said selector component.

29. A labelling machine as set forth in claim 28 wherein the geometric dimensions of the orbit of the center point of said planetary gear, of the radius of said lantern, of the orbit radius of said lanterns, the steepness of the teeth flanks and the modulus of said sun-wheel langern gear teeth are matched to each other whereby a point on the orbit of said lanterns and lying at the shortest distance from said label storage station in a central position of said selector component relative to said label-storage station describes a convex track which intersects the orbit of said lanterns before contacting the rolling contact plane of said label storage station.

30. A labelling machine as set forth in claim 1 wherein said carrier bears at least one further identical selector component for removing labels from a second label storage station and two planetary gears carrying lanterns mesh with one or alternatively two further identical internally toothed sun-wheels.

31. In a labelling machine having a frame, a track, and a sequence of stations along said track, said stations including an adhesive-application station, a label-storage station and a label transfer station;

a rotatable carrier disposed within said track;

at least one label selector component mounted on said carrier for rotating in an opposite direction from said carrier, said selector component having an outwardly curved surface for rolling on an adhesive-application roll at said adhesive application station, for picking-up a label at said label storage station and for applying the label to a container at said label transfer station; and a planetary drive for driving said selector component during rotation of said carrier, said drive including a sun gear fixed in said frame, a toothed lantern gearing on said sun ger having teeth with sloped flanks, said teeth having a dense teeth sequence at said adhesive-application station and a less dense teeth sequence at said label storage station, a drive shaft secured to said selector component, a planetary gear fixed to said shaft, and a plurality of lanterns carried on said planetary gear for rotation about said drive shaft, said lanterns being disposed in meshing relation with said lantern gearing on said sun wheel.

* * * * *